US012669049B2

(12) United States Patent
Ba et al.

(10) Patent No.: US 12,669,049 B2
(45) Date of Patent: Jun. 30, 2026

(54) SYSTEM AND METHOD FOR PREVENTING COLLISIONS IN WELLBORES

(71) Applicant: Schlumberger Technology Corporation, Sugar Land, TX (US)

(72) Inventors: Samba Ba, Houston, TX (US); Hai Feng Li, Beijing (CN); Prateek Goel, Houston, TX (US); Lu Jiang, Beijing (CN); Yang Yuan, Beijing (CN); Chong Wei Wan, Beijing (CN); Ying Fei Hu, Beijing (CN); Jinsoo Kim, Houston, TX (US); Peng Jin, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 388 days.

(21) Appl. No.: 18/489,895

(22) Filed: Oct. 19, 2023

(65) Prior Publication Data

US 2025/0129709 A1 Apr. 24, 2025

(51) Int. Cl.

| | |
|---|---|
| ***E21B 47/022*** | (2012.01) |
| ***E21B 7/04*** | (2006.01) |
| ***E21B 44/00*** | (2006.01) |

(52) U.S. Cl.

CPC ..... *E21B 47/022* (2013.01); *E21B 7/04* (2013.01); *E21B 44/00* (2013.01)

(58) Field of Classification Search

CPC ..... E21B 47/022; E21B 7/04; E21B 44/00

See application file for complete search history.

(56) References Cited

U.S. PATENT DOCUMENTS

| | | | | |
|---|---|---|---|---|
| 7,599,797 | B2 * | 10/2009 | Poedjono | E21B 47/022 702/9 |
| 11,015,433 | B2 | 5/2021 | Li | |
| 11,767,714 | B2 | 9/2023 | Codling | |
| 12,312,933 | B2 | 5/2025 | Ba | |

(Continued)

FOREIGN PATENT DOCUMENTS

| | | |
|---|---|---|
| EP | 3501007 B1 | 2/2023 |
| NO | 20230042 A1 | 1/2023 |
| NO | 20230583 A1 | 5/2023 |

OTHER PUBLICATIONS

Sawaryn et al., "Well-Collision-Avoidance Separation Rule", SPE Drilling Completion, 34, No. 1, Mar. 2019, pp. 01-15 (Year: 2019).*

(Continued)

*Primary Examiner* — Catherine T. Rastovski
*Assistant Examiner* — Sharah Zaab
(74) *Attorney, Agent, or Firm* — Kyle R. Miiller

(57) ABSTRACT

A method of preventing a collision of a subject wellbore in a downhole environment includes receiving offset wellbore data corresponding with one or more offset wellbores and identifying, based on the offset wellbore data, one or more no-go zones for each of the one or more offset wellbores. The method further includes determining a plurality of safe points corresponding with a potential intersection of the subject wellbore with the one or more no-go zones and, defining an escape zone within the plurality of safe points. The method further includes determining a trajectory for the subject wellbore within the escape zone.

16 Claims, 13 Drawing Sheets

(56) References Cited

U.S. PATENT DOCUMENTS

| | | | | |
|---|---|---|---|---|
| 2002/0103630 | A1* | 8/2002 | Aldred | E21B 44/00 703/10 |
| 2015/0292323 | A1* | 10/2015 | Shahri | E21B 49/003 702/9 |
| 2023/0383638 | A1 | 11/2023 | Tayla | |
| 2024/0183263 | A1 | 6/2024 | Ba | |
| 2024/0247578 | A1 | 7/2024 | Ba | |

OTHER PUBLICATIONS

Sawaryn et al., "Well-Collision-Avoidance Management and Principles", SPE Drill Compl, 33, No. 04, Dec. 13, 2018, pp. 335-350 (Year: 2018).*

Sawaryn et al., "Well-Collision-Avoidance Separation Rule", SPE-187073-PA, SPE Drilling Completion, 34, No. 1, Mar. 2019, pp. 01-15.

Sawaryn et al., "Well-Collision-Avoidance Management and Principles", SPE-184730-PA, SPE Drill Compl, 33, No. 04, Dec. 13, 2018, pp. 335-350.

Mansouril et al., "Optimizing The Separation Factor Along a Directional Well Trajectory to Minimize Collision Risk", Journal of Petroleum Exploration and Production Technology, 10, 2020, pp. 2113-2125.

Poedjono et al., "A Comprehensive Approach to Well-Collision Avoidance", AADE National Technical Conference and Exhibition, Apr. 10, 2007, 12 pages.

* cited by examiner

SYSTEM AND METHOD FOR PREVENTING COLLISIONS IN WELLBORES

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be formed in earthen formations using earth-boring tools such as drill bits for drilling wellbores and reamers for enlarging the diameters of wellbores.

In many cases, wellbores may be drilled near one or more existing wellbores, or offset wellbores, in order to enhance reservoir recovery and optimize resource extraction. The nature of drilling near other wellbores, however, introduces the risk of collisions, which may result in costly equipment damage, environmental hazards, operational disruption, and even the loss of life of those operating the downhole system. Thus, accurately determining and adjusting trajectories to avoid collisions with offset wellbores is of paramount importance.

Existing anti-collision methodologies, however, often rely on manual intervention and/or pre-defined static paths. These methods may lack adaptability, may be labor intensive, may be prone to human error, and may lack the ability to provide sufficient speed and clarity to make informed, real-time decisions. Thus, improved systems and methods for continuously, accurately, and automatically monitoring collision risks with offset wellbores may enhance operational safety, improve drilling efficiency, and optimize resource recovery.

SUMMARY

In some embodiments, a method of preventing a collision of a subject wellbore in a downhole environment includes receiving offset wellbore data corresponding with one or more offset wellbores. The method includes identifying, based on the offset wellbore data, one or more no-go zones for each of the one or more offset wellbores. The method includes determining a plurality of safe points corresponding with a potential intersection of the subject wellbore with the one or more no-go zones. The method includes defining an escape zone within the plurality of safe points. The method further includes determining a trajectory for the subject wellbore within the escape zone. In some embodiments, the method is performed by a system. In some embodiments, the method is implemented as instructions stored on a computer-readable storage medium.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure may be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 3-1 illustrates an example implementation of the anti-collision system 120 as described herein, according to at least one embodiment of the present disclosure;

FIG. 3-2 illustrates an example implementation of the anti-collision system 120 as described herein, according to at least one embodiment of the present disclosure;

FIG. 4-1 illustrates an example of a traveling cylinder plot as described herein, according to at least one embodiment of the present disclosure;

FIG. 4-2 illustrates an example of a traveling cylinder plot as described herein, according to at least one embodiment of the present disclosure;

FIG. 4-3 illustrates an example of a traveling cylinder plot as described herein, according to at least one embodiment of the present disclosure;

FIG. 4-4 illustrates an example of a traveling cylinder plot as described herein, according to at least one embodiment of the present disclosure;

FIG. 4-5 illustrates an example of a traveling cylinder plot as described herein, according to at least one embodiment of the present disclosure;

FIG. 5-1 illustrates a flow diagram of an example workflow of the anti-collision system as described herein, according to at least one embodiment of the present disclosure;

FIG. 5-2 illustrates a flow diagram of an example workflow of the anti-collision system as described herein, according to at least one embodiment of the present disclosure;

DETAILED DESCRIPTION

Figure 1:
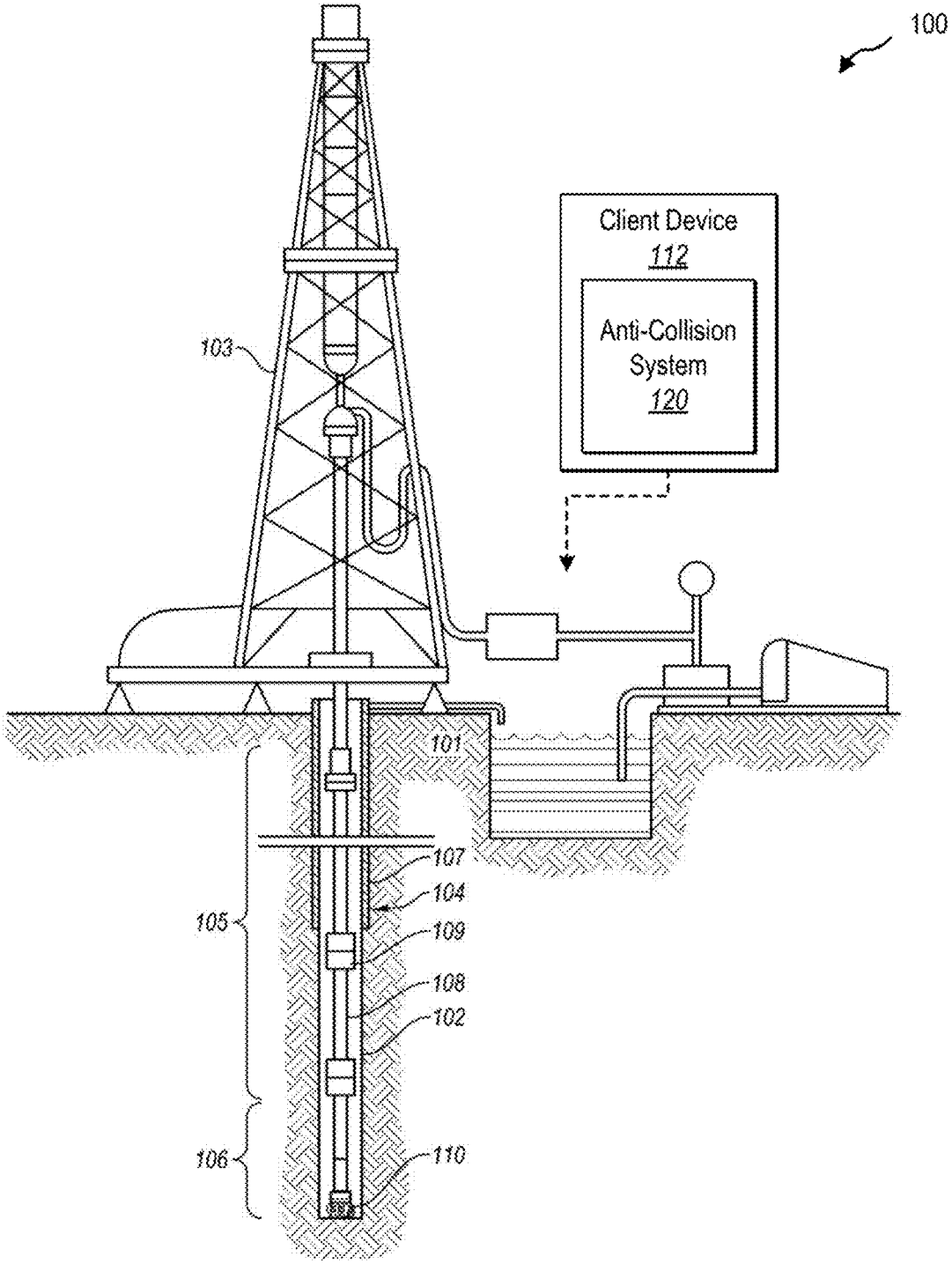
FIG. 1 is an example of a downhole system, according to at least one embodiment of the present disclosure.

This disclosure generally relates to systems, methods, and computer readable storage media for preventing collisions with offset wellbores. An anti-collision system may receive data related to a subject wellbore, such as a geological location, drilling plan, underground target, trajectory, etc., as well as data related to one or more offset wellbores located near the subject wellbore, such as the location, geometry, and trajectory of the offset wellbore. The anti-collision system may generate one or more plots based on the data, such as a 2-dimensional, traveling cylinder (TC) plot. The TC plot may represent the subject well at the origin and may represent one or more relevant offset wellbores as points connected by lines, corresponding to various depths of the subject wellbore and the offset wellbores. Based on the offset wellbore data, the anti-collision system may identify and plot one or more no-go zones to avoid when drilling the offset wellbore. For example, one or more no-go zones may be associated with each offset wellbore representing an uncertainty around a precise location of the offset wellbore. The uncertainty may be derived from the measurements tools and devices used to measure the location of the wellbore. The anti-collision system may segment the TC plot into a plurality of line segments from the origin, the plurality of line segments sweeping around an entire revolution of the plot. Based on an intersection of the lines segments with the no-go zones, the anti-collision system may define a plurality of safe points representing an intersection of each of the line segments with one of the no-go zones that it closest to the origin (e.g., representing a potential intersection of the subject wellbore with one or more no-go zones). In this way, the anti-collision system may define an escape zone by connecting the plurality of safe points. The anti-collision system may similarly incorporate one or more lease lines to further define or limit the escape zone in a similar manner to the no-go zones.

The anti-collision system may determine one or more trajectories for the subject wellbore to avoid collision with the offset wellbores by determining candidate trajectories within the escape zone. For example, based on a proximity of the candidate trajectories to the boundaries of the escape zone, the anti-collision system may determine a collision risk associated with each candidate trajectory. The collision risk may facilitate selecting a trajectory for implementing in connection with the subject wellbore. For example, a candidate trajectory with a lowest collision risk may be selected. In another example, the candidate trajectories may be evaluated based on a cost function that incorporates a variety of factors in addition to the collision risk to select a trajectory that is overall advantageous for the objectives of the subject wellbore based on weighing all of these factors.

In this way, the anti-collision system may facilitate navigating the subject wellbore through potential collisions with offset wellbores. For example, the anti-collision analysis may be performed prior to drilling the subject wellbore as part of a planning phase of the subject wellbore, and/or may be performed one or more times during drilling of the subject wellbore to dynamically adapt to the underground conditions encountered by the subject wellbore. The anti-collision system may automatically update and analyze the TC plots as described as a projection ahead of the subject wellbore, and may facilitate altering the trajectory based on the determined risk of collision of the subject wellbore with one or more offset wellbores.

As will be discussed in further detail below, the present disclosure includes a number of practical applications having features described herein that provide benefits and/or solve problems associated with detecting and avoiding potential collisions of a subject wellbore with one or more offset wellbores. Some example benefits are discussed herein in connection with various features and functionalities provided by an anti-collision system implemented on one or more computing device. It will be appreciated that benefits explicitly discussed in connection with one or more embodiments described herein are provided by way of example and are not intended to be an exhaustive list of all possible benefits of the anti-collision system.

For example, anti-collision analyses are typically user dependent, and rely on skilled operators, drilling engineers, and/or directional drillers to perform much of the analysis. For instance, data such as a TC plot is typically consumed and interpreted by an operator in order to assess collision risks and determine escape routes. In some cases, the generation of the TC plots themselves may be reliant on data gathered, integrated, and/or transformed by a user. Thus, conventional anti-collision techniques rely on the skill, experience, and intuition of directional drillers, drilling engineers, and/or operators, which may introduce human error and inaccuracies, delays, fatigue, iterative limits, etc. By automatically receiving the relevant data and generating the TC plots, as well as automatically determining one or more trajectories within an escape zone, the anti-collision system described herein does not rely on an operator, and may therefore provide anti-collision analyses with a greater degree of accuracy, speed, and reliability, as well as giving consistent results independent of human preferences.

In addition to the benefits of automation generally, the anti-collision system described herein facilitates making informed steering decisions based on more than just a collision risk. For example, conventionally, operators may interpret TC plots in order to generally direct the wellbore free of potential collisions. This technique, however, may fail to consider other important drilling factors such as doglegs, steering angles, steering ratios, etc. The anti-collision system described herein may automatically determine candidate trajectories with an associated risk, and may incorporate these metrics into a cost function that accounts for and weighs a variety of factors. In this way, a trajectory may be selected based on an overall objective for the wellbore, for example, in contrast to only considering potential collisions.

Additionally, the anti-collision system may continuously consume and interpret the relevant data to provide a real-time and continual anti-collision analysis. This provides the ability to dynamically adapt to collision obstacles while drilling and in real-time. For example, the anti-collision system may project a threshold distance ahead of the wellbore by iteratively receiving relevant offset wellbore data where necessary, determining collision risks of the subject wellbore with the offset wellbores, and assessing the current trajectory against potential trajectories to determine an optimal path to reach an underground target (based on many factors in addition to collision risks). This iterative and real-time analysis may provide accuracy, completeness, speed, and reliability over what a user-dependent technique may reasonably achieve. In this way, the anti-collision system may provide valuable anti-collision analysis for planning for a wellbore (e.g., prior to drilling), but may also dynamically update the planned anti-collision analysis during drilling of the wellbore to adapt and change the planned trajectory during drilling.

Additional details will now be provided regarding systems described herein in relation to illustrative figures portraying example implementations. For example, FIG. 1 shows one example of a downhole system 100 for drilling an earth formation 101 to form a wellbore 102. The downhole system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of the drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 further includes additional downhole drilling tools and/or components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110, other downhole drilling tools, or other components. An example BHA 106 may include additional or other downhole drilling tools or components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system 100 may include other downhole drilling tools, components, and accessories such as special valves (e.g., kelly cocks, blowout preventers, and safety valves). Additional components included in the downhole system 100 may be considered a part of the drilling tool assembly 104, the drill string 105, or a part of the BHA 106, depending on their locations in the downhole system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to the surface, or may be allowed to fall downhole. The bit 110 may include one or more cutting elements for degrading the earth formation 101.

The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory. The RSS may steer the bit 110 in accordance with or based on a trajectory for the bit 110. For example, a trajectory may be determined for directing the bit 110 toward one or more subterranean targets such as an oil or gas reservoir.

The downhole system 100 may be operated in accordance with a drilling plan. For example, a drilling plan may include instructions, plans, procedures, designs, objectives etc. for directing the operation of the various subsystems, processes, and objectives of the downhole system 100.

The downhole system 100 may include one or more client devices 112 with an anti-collision system 120 implemented thereon (e.g., implemented on one, several, or across multiple client devices 112). The anti-collision system 120 may facilitate determining and incorporating one or more trajectories and/or changes to trajectories of the downhole system 100. For example, the downhole system 100 may be implemented at a location where one or more existing wellbores (e.g., offset wellbores) are adjacent or near to a subject wellbore associated with (e.g., being or to be drilled by) the downhole system 100. The anti-collision system 120 may facilitate determining and/or selecting one or more trajectories such that the subject wellbore does not intersect or collide with any of the offset wellbores.

Figure 2:
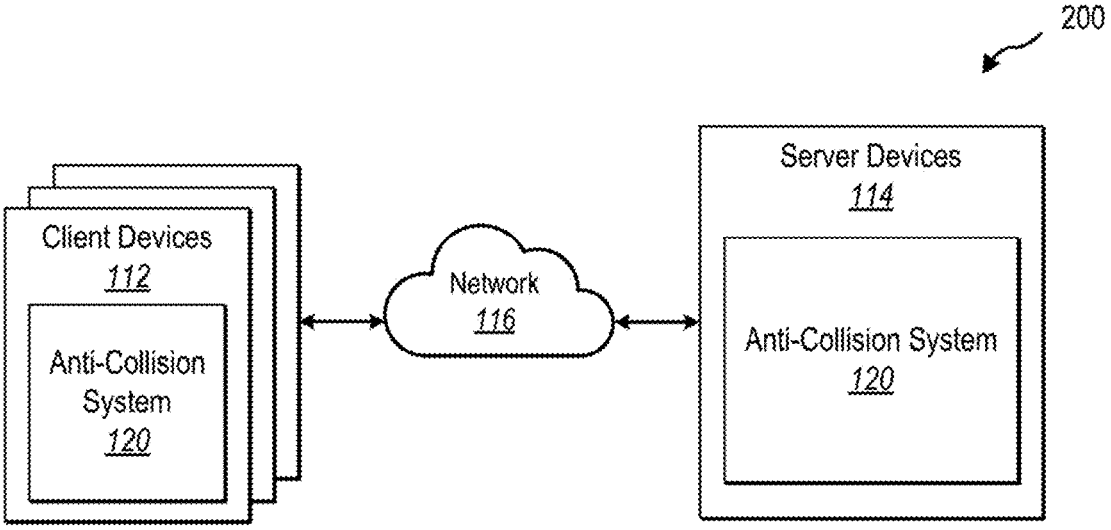
FIG. 2 illustrates an example environment 200 in which the anti-collision system 120 is implemented in accordance with at least one embodiment of the present disclosure.

FIG. 2 illustrates an example environment 200 in which an anti-collision system 120 is implemented in accordance with one or more embodiments describe herein. As shown in FIG. 2, the environment 200 includes one or more server device(s) 114. The server device(s) 114 may include one or more computing devices (e.g., including processing units, data storage, etc.) organized in an architecture with various network interfaces for connecting to and providing data management and distribution across one or more client systems. As shown in FIG. 2, the server devices 114 may be connected to and may communicate with (either directly or indirectly) one or more client devices 112 through a network 116. The network 116 may include one or multiple networks and may use one or more communication platforms or technologies suitable for transmitting data. The network 116 may refer to any data link that enables transport of electronic data between devices of the environment 200. The network 116 may refer to a hardwired network, a wireless network, or a combination of a hardwired network and a wireless network. In one or more embodiments, the network 116 includes the internet. The network 116 may be configured to facilitate communication between the various computing devices via well-site information transfer standard markup language (WITSML) or similar protocol, or any other protocol or form of communication.

The client device 112 may refer to various types of computing devices. For example, one or more client devices 112 may include a mobile device such as a mobile telephone, a smartphone, a personal digital assistant (PDA), a tablet, a laptop, or any other portable device. Additionally, or alternatively, the client devices 112 may include one or more non-mobile devices such as a desktop computer, server device, surface or downhole processor or computer (e.g., associated with a sensor, system, function, etc. of the downhole system), or other non-portable device. In one or more implementations, the client devices 112 include graphical user interfaces (GUI) thereon (e.g., a screen of a mobile device). In addition, or as an alternative, one or more of the client devices 112 may be communicatively coupled (e.g., wired or wirelessly) to a display device having a graphical user interface thereon for providing a display of system content. The server devices(s) 114 may similarly refer to various types of computing devices. Each of the devices of the environment 200 may include features and functionalities described below in connection with FIG. 7.

As shown in FIG. 2, the environment 200 may include an anti-collision system 120 implemented on one or more computing devices. The anti-collision system 120 may be implemented on one or more client device 112, server devices 114, and combinations thereof. Additionally, or alternatively, the anti-collision system 120 may be implemented across the client devices 112 and the server devices 114 such that different portions or components of the anti-collision system 120 are implemented on different computing devices in the environment 200. In this way, the environment 200 may be a cloud computing environment, and the anti-collision system 120 may be implemented across one or more devices of the cloud computing environment in order to leverage the processing capabilities, memory capabilities, connectivity, speed, etc. that such cloud computing environments offer in order to facilitate the features and functionalities described herein.

Figures 1, 3:
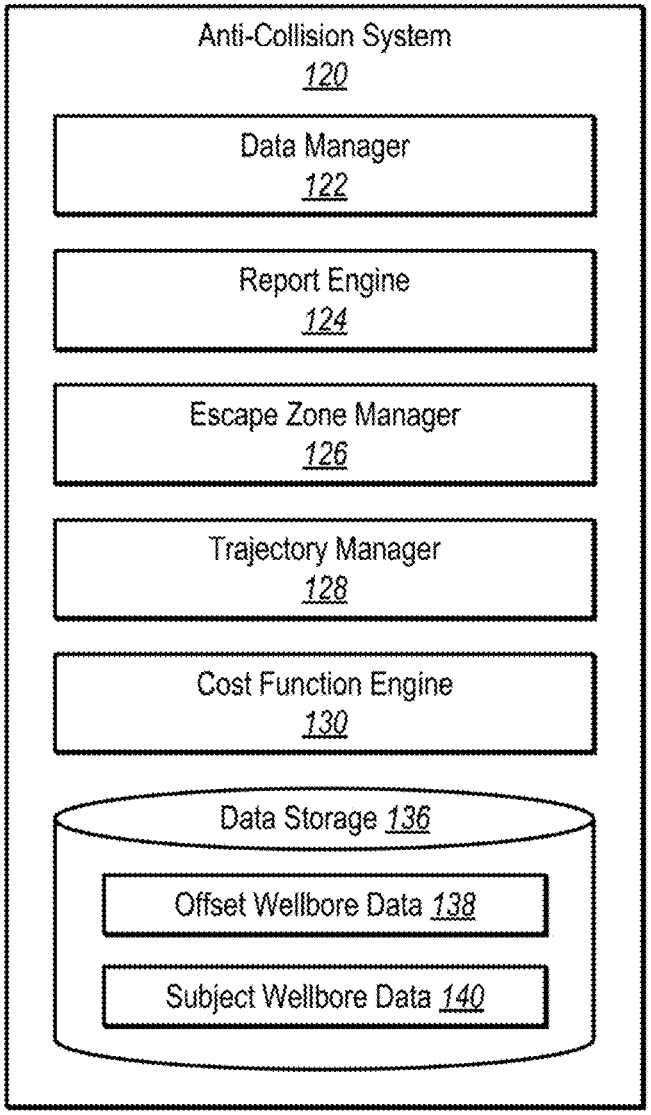
Figures 2, 3:
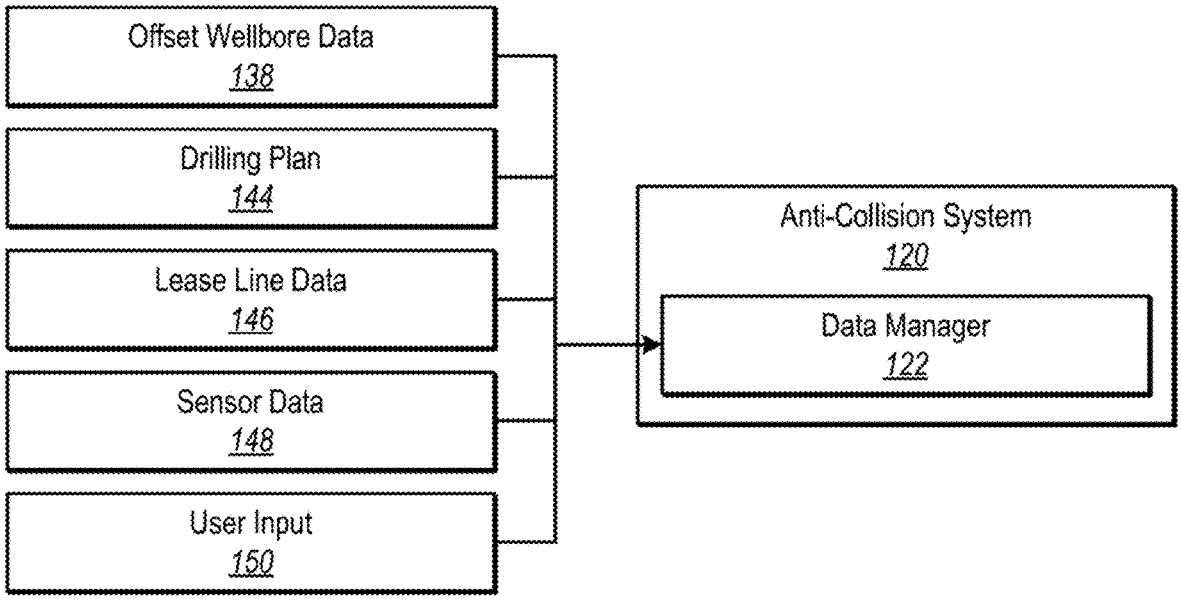

FIG. 3-1 illustrates an example implementation of the anti-collision system 120 as described herein, according to at least one embodiment of the present disclosure. The anti-collision system 120 may include a data manager 122, a report engine 124, an escape zone manager 126, a trajectory manager 128, and a cost function engine 130. The anti-collision system 120 may also include a data storage 136 having offset wellbore data 138, and subject wellbore data 140, stored thereon. While one or more embodiments described herein describe features and functionalities performed by specific components 122-130 of the anti-collision system 120, it will be appreciated that specific features described in connection with one component of the anti-collision system 120 may, in some examples, be performed by one or more of the other components of the anti-collision system 120.

By way of example, one or more of the data receiving, gathering, and/or storing features of the data manager 122 may be delegated to other components of the anti-collision system 120. As another example, while safety points and tolerance lines may be determined by the escape zone manager 126, in some instances, some or all of these features may be performed by the trajectory manager 128 (or other component of the anti-collision system 120). Indeed, it will be appreciated that some or all of the specific components may be combined into other components and specific functions may be performed by one or across multiple of the components 122-130 of the anti-collision system 120.

Additionally, while FIG. 1, for example, depicts the anti-collision system 120 implemented on a client device 112 of the downhole system, it should be understood that some or all of the features and functionalities of the anti-collision system 120 may be implemented on or across multiple client devices 112 and/or server devices 114. For example, one or more trajectories may be determined by the trajectory manager 128 on a (e.g., local) client device, and a trajectory may be selected by the cost function engine 130 on a remote, server, and/or cloud device. Indeed, it will be appreciated that some or all of the specific components 122-130 may be implemented on or across multiple client devices 112 and/or server devices 114, including individual functions of a specific component being performed across multiple devices.

As mentioned above, the anti-collision system 120 includes a data manager 122. As shown in FIG. 3-2, the data manager 122 may receive and manage a variety of types of data of the anti-collision system 120. For example, the data manager 122 may receive offset wellbore data 138. The offset wellbore data 138 may correspond to one or more existing wellbores or offset wellbores, such as within a threshold proximity to a subject wellbore. For example, the offset wellbores may be wellbores that are in a same oil/gas field, basin, formation, geographic location, etc. as the subject wellbore. The offset wellbore data 138 may include information regarding each of these offset wellbores. For example, the offset wellbore data 138 may include information regarding the offset wellbores' geometry, trajectory, geological and geophysical information, well completion and production information, directional surveys, wellbore integrity, wellbore stability, wellbore control, drill string integrity during the construction of that wellbore, drilling logs, formation evaluation logs, operational reports, any other information associated with the offset wellbores, and combinations thereof.

In some embodiments, the offset wellbore data 138 includes a buffer, threshold, or no-go zone associated with the location, geometry, and/or trajectory of each offset wellbore (at one or more or all depths of the offset wellbores). For example, the no-go zone may be a circle, ellipsoid, or any other shape which may outline an area of a known or predicted location of the offset wellbore (at one or more depths), such as the no-go zones 455 shown in FIG. 4-1. In some embodiments, the no-go zone represents an uncertainty associated with the offset wellbore. For example, an exact or precise location of the offset wellbore at one or more depths may be unknown or uncertain. The uncertainty may be due to unreliable, incomplete, nonexistent, or otherwise insufficient data, such as due to an age of the offset wellbore or due to a type of measurement tool that was used. The no-go zone may outline an area where the offset wellbore is expected or predicted to be to a certain degree (e.g., in contrast to representing an exact location of the wellbore with a single point for example). Put another way, an exact position of the offset wellbore may be uncertain, and the offset wellbore may be expected or predicted to be somewhere within the associated no-go zone within a threshold (e.g., percentage of) certainty. For example, an offset wellbore having a greater uncertainty may have a larger associated no-go zone (e.g., larger radius), and an offset wellbore having a smaller uncertainty may have a smaller associated no-go zone (e.g., smaller radius). In this way, the no-go zones may represent areas that present a level of risk for colliding with or intersecting an existing, offset wellbore.

In some embodiments, the data manager 122 receives one or more no-go zones associated with the offset wellbores. For example, the offset wellbore data 138 may be maintained in a central database (e.g., in the server device 114) and the no-go zones may be maintained in the database as well. In some embodiments, the data manager 122 calculates and/or determines one or more no-go zones. For example, the no-go zones may be determined based on the offset wellbore data 138 in connection with one or more established industry standards (e.g., ISCWSA standards), client standards, user defined parameters, etc. The data manager 122 may upload and/or maintain the no-go zones in the database.

In some embodiments, the data manager 122 updates and/or modify the offset wellbore data 138 in the database, including the no-go zones, as described herein. In some embodiments, while drilling the subject wellbore, information is gathered regarding one or more offset wellbores. For example, downhole measurement tools may detect the presence (or lack thereof) and location of an offset wellbore. The data manager 122 may accordingly update the offset wellbore data 138. In another example, the no-go zone for a particular offset wellbore may outline or encompass a given area, and the subject wellbore may be made to successfully pass through that area (e.g., an operator may override a no-go zone such as based on their knowledge and/or experience). The data manager 122 may accordingly update the offset wellbore data 138 to reflect that the offset wellbore was not in that location. The data manager 122 may modify and/or update the offset wellbore data 138 automatically and/or based on user input.

In some embodiments, the data manager 122 refines the offset wellbore data 138. For example, the offset wellbore data 138 may indicate that an offset wellbore is located near the subject wellbore, but the data may not be sufficient to verify a location, establish a no-go zone, etc. for the offset wellbore. The data manager 122 may accordingly get additional information to supplement the offset wellbore data 138 in order to establish a location, no-go zone, etc. for that offset wellbore. For example, the data manager 122 may search one or more additional devices or databases for additional data related to the offset wellbore. In another example, the data manager 122 may facilitate taking one or more measurements or surveys regarding the offset wellbore in order to supplement the offset wellbore data 138, such as indicating to or prompting a user for the measurements. The data manager 122 may refine the offset wellbore data 138 automatically and/or based on user input.

In some embodiments, the data manager 122 requests or receives additional offset wellbore data 138. For example, the data manager 122 may initially receive offset wellbore data for offset wellbores near the subject well. As the offset wellbore is drilled and/or if a trajectory or plan of the offset wellbore is changed, additional offset wellbores may become relevant (e.g., be positioned near) to the subject wellbore. Similarly, one or more of the offset wellbores may no longer be relevant (e.g., may be directed away from) the subject wellbore. The data manager 122 may accordingly receive additional wellbore data 138 regarding the additional relevant offset wellbores, and/or may disregard offset wellbore data 138 regarding the no longer relevant offset wellbores. This may be based on user input and/or may be performed automatically (e.g., with little or no user input) by the data manager 122.

In some embodiments, the data manager 122 creates new offset wellbore data 138. For example, information may be gathered during drilling of the subject wellbore (e.g., sensor data, drilling logs, steering information, etc.). The data manager 122 may receive and store this information as offset wellbore data 138 for use in future drilling operations. In this way, the subject wellbore may, in the future, become an offset wellbore for a future wellbore, and the data manager 122 may accordingly maintain the offset wellbore data 138 with this information regarding the (e.g., current) subject wellbore.

In some embodiments, the data manager 122 receives a drilling plan 144. The drilling plan 144 may include one or more objectives of the subject wellbore such as a type, location, etc. of a target well or target reservoir. The drilling plan 144 may include or may outline one or more procedures for drilling the subject wellbore. The drilling plan 144 may include one or more planned or potential trajectories for the subject wellbore to access a target reservoir. In some embodiments, the drilling plan 144 includes one or more rulesets for drilling the subject wellbore (e.g., for implementing a trajectory). For example, the rulesets may include or may define one or more thresholds for assessing collision risks of the subject wellbore as well as exceptions for proceeding when presented with risks, as described herein. The rulesets may define a threshold distance (e.g., feet), as well as a frequency, to project or analyze, for example, ahead of a bit to assess collision risks for the subject wellbore, as described herein. The rulesets may define an allowable deviation from a planned trajectory of the subject wellbore. The rulesets may include rules for determining and/or modifying no-go zones as described herein. In some embodiments, the rules of the rulesets are defined by one or more industry standards, client defined standards, operator defined parameters or procedures, any other rules, and combinations thereof.

In some embodiments, the data manager 122 receives lease line data 146 corresponding with a geographic location for the subject wellbore to be drilled. For example, the subject wellbore may be associated with a specific area of real property which is leased for the purpose of drilling the subject well. The downhole system may be subject to one or more legal requirements to maintain the subject wellbore within certain geographic boundaries or lease lines. The data manager 122 may receive lease lines associated with one or more of these geographic boundaries.

In some embodiments, the data manager 122 receives sensor data 148. The sensor data 148 may include measurements from any number of sensors included or associated with the downhole system. For example, the sensor data 148 may include measurements from reservoir mapping tools, formation evaluation tools, logging while drilling (LWD) tools, and/or measurement while drilling (MWD) tools. The sensor data 148 may include measurements from downhole sensors and surfaces sensors. The sensor data 148 may include measurements from gamma ray sensors, resistivity sensors, neutron density sensors, porosity sensors, acoustic sensors, temperature sensors, pressure sensors, depth sensors, any other sensor, and combinations thereof. The sensor data 148 may include data from one or more surveying tools. The data manager 122 may receive the sensor data 148 from any sensor in communication with the downhole system.

In some embodiments, the data manager 122 receives user input 150. The data manager 122 may receive the user input 150, for example, via any of the client devices 112 and/or server devices 114. Any of the data described herein may be input or augmented via the user input 150. For example, in some instances, some or all of the sensor data 148 may be received by the data manager 122 as user input. In some instances, some or all of the lease line data 146 is received by the data manager 122 as user input 150. As will be described herein, the user input 150 may be received in associated with one or more functions or features of the anti-collision system 120, such as part of determining and/or selecting a trajectory, or as part of evaluating and proceeding with collision risk. In this way, the data manager 122 may receive the user input 150 to the anti-collision system 120.

The data manager 122 may save and/or store any of the data it receives to the data storage 136. For example, the data manager 122 may store data associated with or pertaining to one or more offset wellbores as offset wellbore data 138. The data manager 122 may receive some or all of the wellbore data 138 as discussed above, and may also generate, save, and/or store any additional data as wellbore data 138. The data manager 122 may store data associated with the subject wellbore as subject wellbore data 140. For example, some or all of the drilling plan 144, lease line data 146, sensor data 148, etc. may be saved as subject wellbore data 140.

Figures 1, 4:
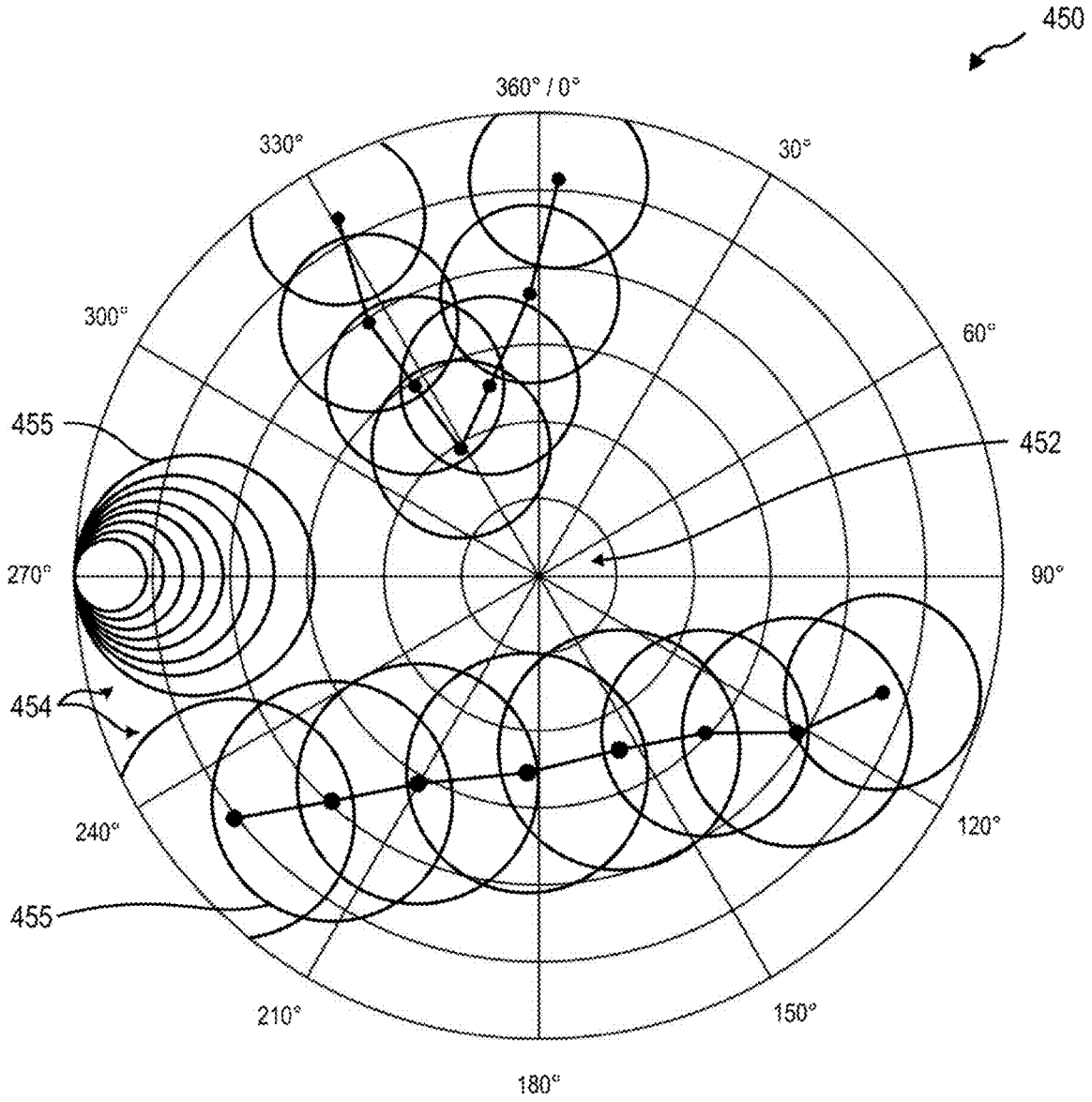
Figures 2, 4:
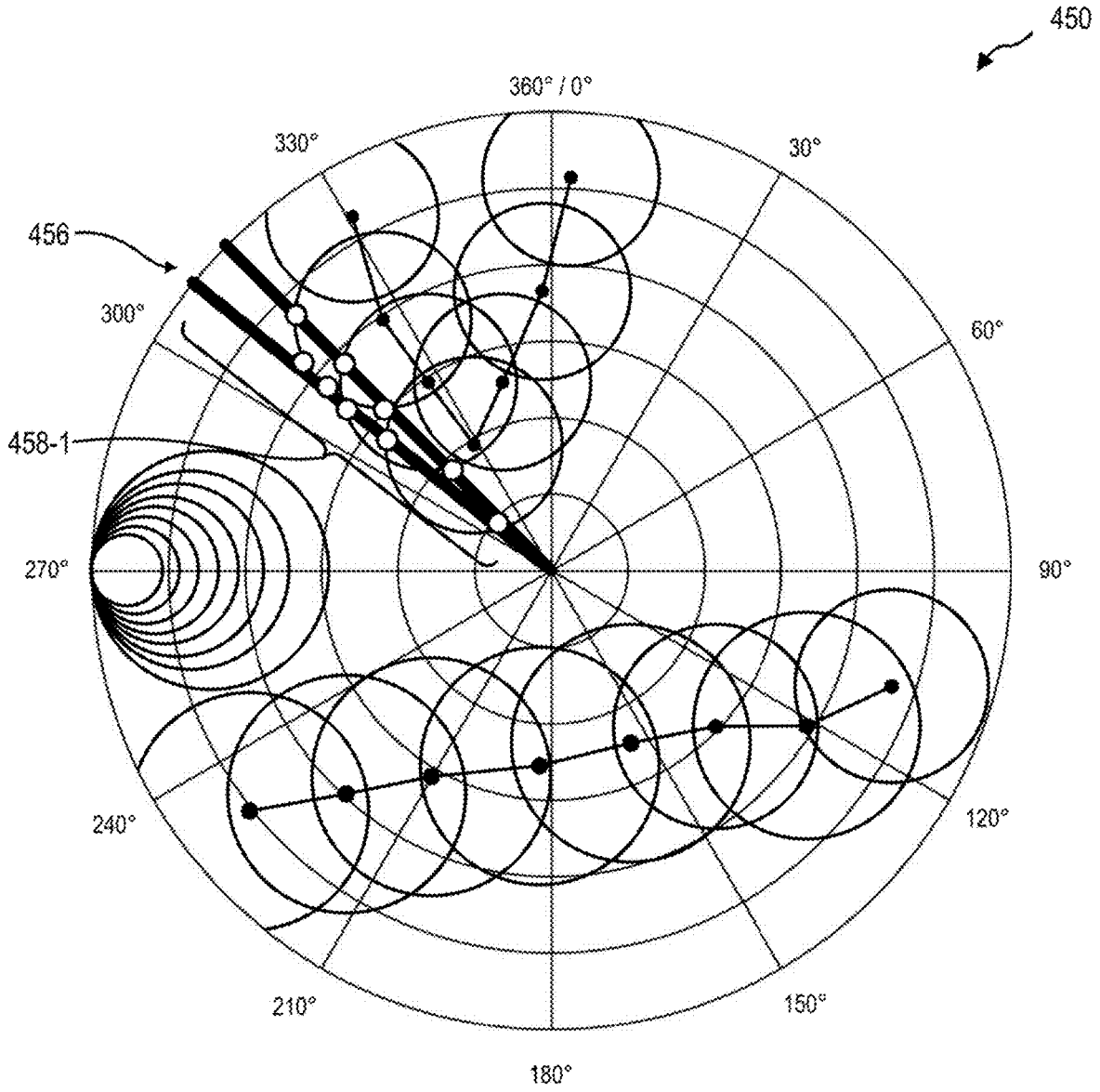
Figures 3, 4:
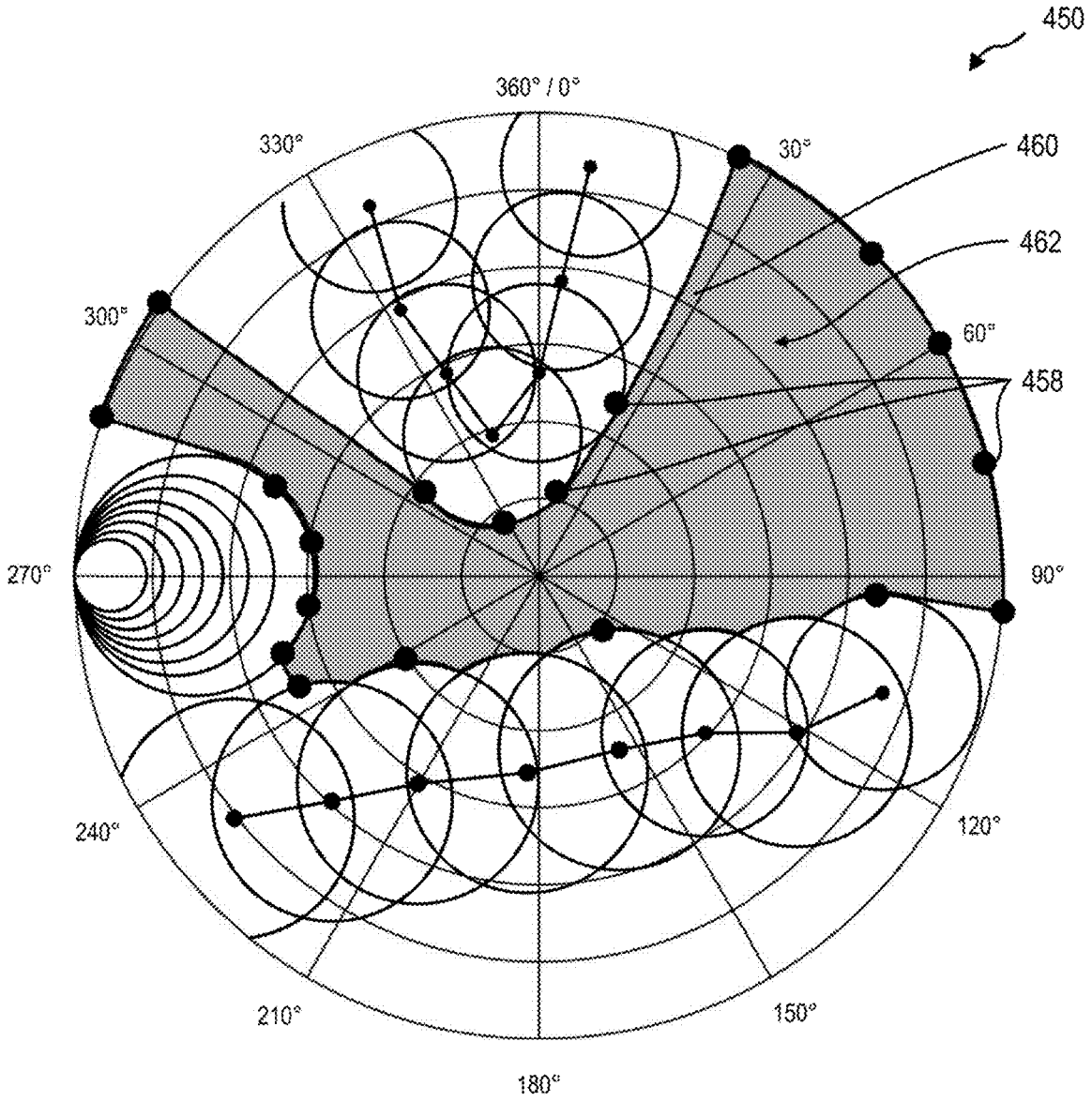
Figure 4:
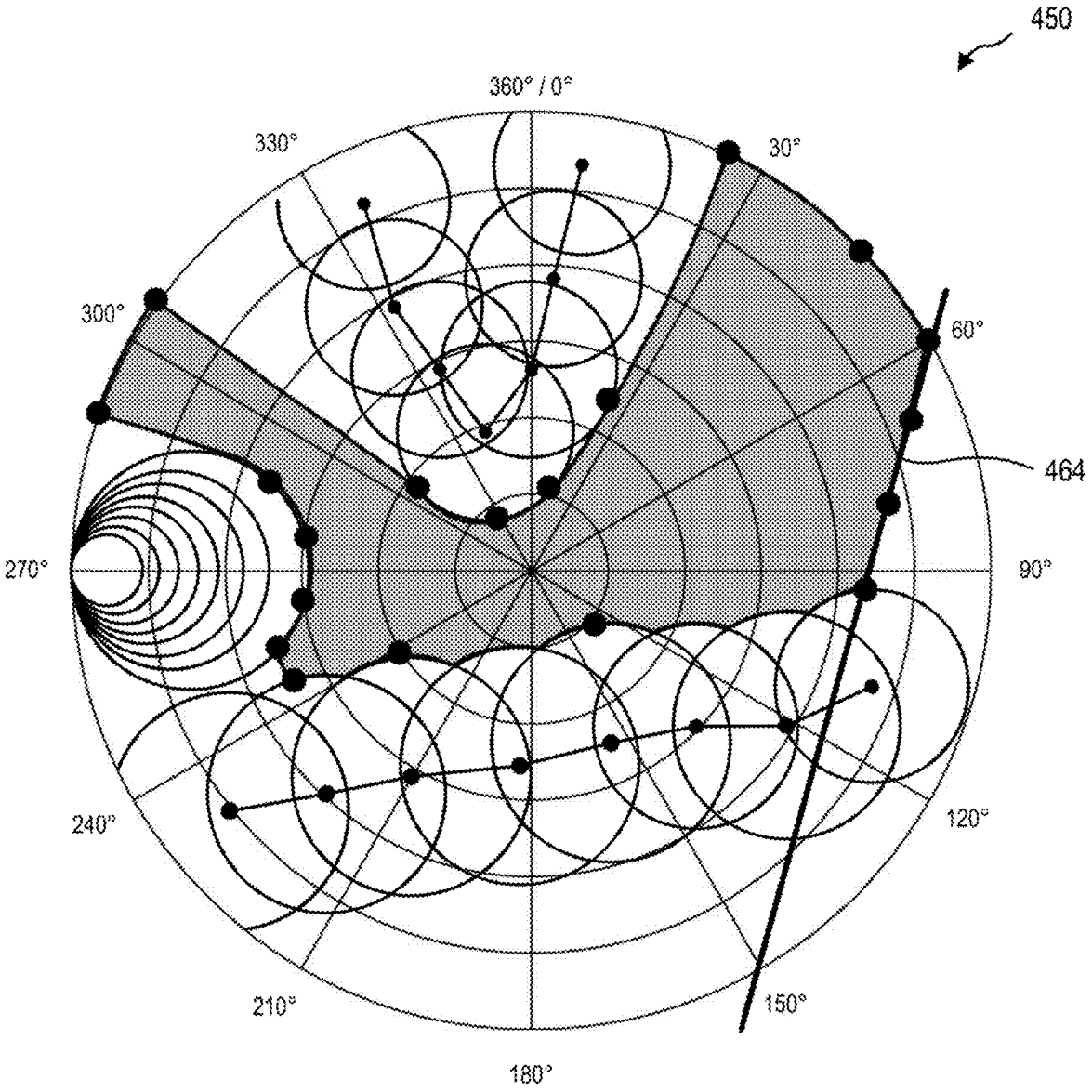

As mentioned above, the anti-collision system 120 includes a report engine 124. The report engine 124 may generate one or more reports. In some embodiments, the report engine 124 generates one or more plots. For example, as shown in FIG. 4-1 the report engine 124 may generate a TC plot 450. The report engine 124 may aggregate data from the offset wellbore data 138 and/or the subject wellbore data 140 to generate the TC plot 450. The TC plot 450 may be a 2-dimensional plot that may represent 3-dimensional aspects of the subject wellbore and one or more offset wellbores. For example, the center or origin of the TC plot 450 may represent a position or location of the subject wellbore 452, such as a bottom or measurement depth (MD) of the subject wellbore (e.g., at bit or BHA of the downhole system). The TC plot 450 may be a representation of a plane perpendicular or normal to the subject wellbore. In this way the TC plot may conceptually represent, in 2-dimensional space, a perspective or view from the subject wellbore of one or more surrounding features (e.g., offset wellbores). For example, the TC plot 450 may represent a projection of a given distance ahead of the subject wellbore. In some embodiments, one or more TC plots 450 may be generated to represent projections at various distances ahead of the subject wellbore.

The TC plot 450 may include one or more offset wellbores 454. The offset wellbores 454 may be represented by one or more points connected by a line. The points of the offset wellbores 454 may represent the location of the offset wellbores 454 at different depths of the offset wellbores 454. A proximity of the points and/or line of the offset wellbores 454 to the origin of the TC plot 450 may represent a proximity of the offset wellbores 454 to the subject wellbore 452. The TC plot 450 may include one or more no-go zones 455 for the offset wellbores 454. In some embodiments, the TC plot 450 includes a representation of one or more lease lines associated with the subject wellbore 452, as described herein.

In some embodiments, the report engine 124 plots one or more safe points, tolerance lines, escape zones, and/or trajectories on the TC plot 450, as discussed herein. In some embodiments, the report engine 124 presents the TC plot via a graphical user interface, for example, to a user of the anti-collision system 120. The report engine 124 may store the TC plot to the data storage 136 as subject wellbore data 140.

As mentioned above, the anti-collision system 120 includes an escape zone manager 126. The escape zone manager 126 may facilitate identifying one or more escape zones, or areas and/or directions in which the subject wellbore 452 may have less risk of collision with an offset wellbore 454.

In some embodiments, the escape zone manager 126 receives or accesses the TC plot 450 from the data storage 136. As shown in FIG. 4-2, the escape zone manager 126 may segment the TC plot 450 into one or more segments 456. The segments 456 may be defined by a line from the origin to the perimeter of the TC plot 450. In this way, the segments 456 may represent a division of the TC plot 450 into one or more angles in a sequential rotation around the origin.

In some embodiments, the escape zone manager 126 identifies the no-go zones 455 associated with each of the offset wellbores 454 (e.g., from the offset wellbore data 138). For each of the segments 456, the escape zone manager 126 may determine each intersection of the segment 456 with a boundary of the no-go zones 455. These intersections may define one or more candidate safe points 458-1 for the segment 456 (e.g., one or more potential intersections of the subject wellbore 452 with the no-go zones 455). From the candidate safe points 458-1, the escape zone manager 126 may determine which of the candidate safe points 458-1 is closest to the origin (e.g., to the subject wellbore 452) and may select this candidate safe point 458-1 as the safe point 458 for the segment 456. In this way, the safe point 458 for the segment 456 may represent a potential intersection (or collision) of the subject wellbore 452 with an offset wellbore 454 that is closest to the subject wellbore 452 for that segment 456. Put another way, the safe point 458 for the segment 456 may be a most restrictive proximity to the subject wellbore 452 when compared to all of the plurality of candidate safe points 458-1. As shown in FIG. 4-3, the escape zone manager 126 may select a safe point 458 in this manner for each of the segments 456 of the TC plot 450, for example, by sequentially sweeping around the TC plot 450. In this way, the escape zone manager 126 may selected a plurality of safe points 458 that substantially represent an entire revolution around the TC plot 450. The escape zone manager 126 may store the safe points 458 to the data storage 136 as part of the subject wellbore data 140. The safe points 458 may be plotted on the TC plot 450, for example, by the report engine 124.

In some embodiments, the escape zone manager 126 determines one or more tolerance lines 460. For example, the tolerance lines 460 may be lines between safe points 458 of adjacent segments 456. The tolerance lines 460 may accordingly connect all of the safe points 458 into an enclosed area, or escape zone 462. The escape zone 462 may represent a direction or area in which the subject wellbore 452 may be directed that is substantially free of potential collisions with the offset wellbores 454. In some embodiments, the escape zone manager 126 determines the escape zone 462 based on user input. For example, the escape zone manager 126 may present the safe points 458, the tolerance lines 460, and/or the escape zone 462 to a user, such as via a GUI. The escape zone manager 126 may facilitate the user modifying, adjusting, or otherwise changing one or more of the safe points 458, the tolerance lines 460 and/or the escape zone 462.

In some embodiments, the escape zone manager 126 incorporates one or more lease lines 464 into the workflow just described. For example, the escape zone manager 126 may identify a geological boundary associated with a leased plot of land (e.g., from the subject wellbore data 140), and may accordingly generate one or more lease lines 464, as shown in FIG. 4-4. The escape zone manager 126 may determine candidate safe points 458-1 associated with the lease lines 464 based on intersections of each segment 456 with the lease lines 464 in a similar manner to the no-go zones 455. In this way, the escape zone manager 126 may further define (or limit) the escape zone 462 based on the lease lines 464 to facilitate maintaining the subject wellbore within an associated geographical boundary. The escape zone manager 126 may store the tolerance lines 460, lease lines 464, and escape zone 462 to the data storage 136 as part of the subject wellbore data 140. Additionally, the report engine 124 may plot any of the tolerance lines 460, lease lines, 464, and escape zone 462 to the TC plot 450.

In this way, the anti-collision system 120 may identify one or more offset wellbores 454 (and/or lease lines 464) as potential obstacles for the subject wellbore to avoid, may determine boundaries (e.g., tolerance lines 460) around the potential obstacles, and may define a safe area (e.g., escape zone 462) or direction for the subject wellbore to proceed. In some embodiments, the anti-collision system 120 performs these functionalities automatically and without user input. This may be in contrast to conventional techniques, which typically rely heavily on operator-defined boundaries and thresholds, as well as operator interpretation of the subject wellbore's trajectory in relation to obstacles such as offset wellbores. Such techniques may be labor intensive, slow, and/or may be prone to human error. In this way, the anti-collision system 120 may be advantageous by providing automated, quick, and accurate anti-collision analysis for the subject wellbore.

As mentioned above, the anti-collision system 120 may include a trajectory manager 128. The trajectory manager 128 may facilitate determining one or more trajectories for avoiding collisions with the offset wellbores 454. For example, the trajectory manager 128 may receive or access the TC plot 450 from the data storage 136, including the safe points 458, escape zone 462, etc. described herein. Based on the TC plot 450, the trajectory manager 128 may identify one or more candidate trajectories for the subject wellbore 452 within the escape zone 462. For example, in the example shown in FIG. 4-2, the trajectory manager 128 may identify the area from about 20° to about 90° as an area substantially free of obstacles, and may determine one or more candidate trajectories for directing the subject wellbore 452 in that general direction. In another example, the trajectory manager 128 may identify the area around about 330° as a potential direction for the subject wellbore 452 to proceed for potentially avoiding obstacles, and may accordingly determine one or more candidate trajectories in that general direction. In some embodiments, the trajectory manager 128 determines one or more candidate trajectories based on user input. For example, the trajectory manager 128 may present the TC plot 450 and/or the associated escape zone 462 to a user and may facilitate the user determining one or more candidate trajectories. In another example, the trajectory manager 128 may present one or more candidate trajectories, and may facilitate a user selecting a trajectory from the candidate trajectories. In another example, the trajectory manager 128 may facilitate a user modifying, adjusting, and/or changing one or more candidate trajectories. In some embodiments, the report engine 124 plots one or more candidate trajectories on the TC plot 450, such as the example trajectory 466 shown in FIG. 4-5.

In some embodiments, the trajectory manager 128 evaluates a collision risk (e.g., a percentage) associated with one or more of the candidate trajectories. For example, the trajectory manager 128 may determine the risk of the subject well 452 colliding with an offset well 454 (or crossing a lease line 464) for a given trajectory based on a proximity of the subject well 452 to the tolerance lines 460, no-go zones 455, etc. A trajectory that approaches closer to the boundary of the escape zone 462 may be assigned a higher risk percentage and a trajectory that does not closely approach the boundary may be assigned a lower risk percentage. In some embodiments, the trajectory manager 128 determines one or more candidate trajectories automatically. In some embodiments, the trajectory manager 128 facilitates determining one or more candidate trajectories, for example, based on user input.

In some embodiments, the trajectory manager 128 facilitates selecting a trajectory from the candidate trajectories. For example, the trajectory manager 128 may present several candidate trajectories to a user, and a trajectory may be selected based on input from the user. In some embodiments, the trajectory manager 128 may observe and/or discern a behavioral preference of the user based on these interactions. For example, the trajectory manager 128 may observe that the user tends to strictly adhere to the determined constraints such as the no-go zones 455, escape zone 462, etc. In another example, the trajectory manager 128 may observe that the user tends to forgo or override one or more determined constraints and/or types of constraints. In some embodiments, the trajectory manager 128 learns these behavioral preferences and accordingly determines and/or presents one or more trajectories based on incorporating these user preferences. In some embodiments, the trajectory manager automatically selects a trajectory without any user input. For example, the trajectory manager 128 may determine several (or all) candidate trajectories for the subject well 452 within the escape zone 462 and may select a trajectory that has a lowest (or no) collision risk. The trajectory manager 128 may store the selected trajectory to the data storage as subject wellbore data 140.

In some embodiments, the trajectory manager 128 determines one or more candidate trajectories, but may not select a trajectory. For example, as mentioned above, the anti-collision system 120 may include a cost function engine 130 which may facilitate selecting a trajectory. The cost function engine 130 may receive or may access, from the trajectory manager 128, one or more candidate trajectories and the associated collision risks. For example, the cost function engine 130 may receive a predetermined quantity of candidate trajectories such as a quantity of trajectories having a lowest associated collision risk. In another example, the cost function engine 130 may receive all candidate trajectories within the escape zone 462 having an associated risk within a predetermine threshold. In another example, the cost function engine 130 may receive all candidate trajectories within the escape zone 462. In some embodiments, the cost function engine 130 selects a trajectory based on the trajectory having a lowest (or no) collision risk.

In some embodiments, the cost function engine 130 selects a trajectory based on factors in addition to the anti-collision analysis/collision risk. For instance, in some cases a candidate trajectory that is determine based on the escape zone 462 may not be practical or desirable based on other factors. For example, a candidate trajectory may be determined to have a low (or lowest) collision risk but may implement a geometry that is not suitable for the drilling tool assembly, such as a high dogleg or a high number of turns or curves. In another example, a clearer or less crowded area of the escape zone 462 may be in a direction that is oriented away from a target or planned direction for the subject wellbore, and accordingly a candidate trajectory leading in that direction may not be desirable for implementing for the subject wellbore 452.

In some embodiments, the cost function engine 130 implements a cost function for considering and weighing a variety of factors in order to select an optimal or advantageous trajectory based on more than just the collision risk. For example, the cost function may account for properties such as one or more of trajectory length, steering length, average steering ratio, maximum steering ratio, average deviation, maximum deviation, snaking, steering risk, angular deviation, endpoint distance, endpoint angle, target forward, number of curves, directional difficulty index (DDI), any other parameter, and combinations thereof. The cost function engine 130 may determine a normalized cost value $C_i$ of each of the properties. The normalized cost value $C_i$ may be a value between 0 and 1. Each property may have a context-dependent weight factor $W_i$ representing a relative importance of the property. In some embodiments, one or more parameters are constrained by an associated boundary or limit, and a penalty $P_k$ is applied for each violating the limit. A weight $V_k$ may be applied to the penalty $P_k$ (e.g., for violating the limit) representing a relative severity or importance of the limit. The cost function engine 130 may determine or calculate any of these values and/or may receive and/or modify any of these values, such as based on user input. A total cost $C_{tot}$ for a candidate trajectory may therefore be determined by the following formula:

$$C_{tot} = \sum_i C_i W_i + \sum_k V_k P_k$$

In this way, the collision risk of the candidate trajectory may be determined and provided to the cost function engine 130 as one of a number of factors to consider when evaluating and selecting a trajectory.

In some embodiments, the cost function engine 130 is implemented as a cloud computing component of the anti-collision system 120. For example, the various parameters may be received (e.g., to a server device) from a variety of sources and/or devices, and the cost function engine 130 may be implemented in one or more cloud computing resources in order to analyze the parameters and/or implement the cost function. In some embodiments, the cost function engine 130 is implemented in the anti-collision system 120 in connection to one or more (e.g., distinct) systems associated with the downhole system and/or the subject wellbore. For example, the anti-collision system 120 may provide the candidate trajectories and associated collision risks to another system for implementing the cost function engine 130. In this way, some or all of the functionalities of the cost function engine 130 may be performed by a separate (e.g., or higher tiered) system in communication with the anti-collision system 120. For example, the anti-collision system 120 may be a subsystem of a greater downhole computing system for determining and implementing trajectories, and the greater system may implement the cost function engine 130 in or across one or more systems or components in addition to the anti-collision system 120. In this way, the anti-collision system 120 (and the cost function engine 130) may leverage the capabilities of cloud computing resources in order to provide, fast, robust, and complete computations and information, for example, in order to facilitate making informed decisions regarding implementing a potential trajectory for the subject wellbore 452.

In some embodiments, the anti-collision system 120 performs one or more of the features described herein for an entirety of a length of the subject wellbore 452. This may be as part of a planning phase for the subject wellbore 452, for example, prior to drilling the subject wellbore 452. In some embodiments, the anti-collision system 120 performs one or more of the features described herein during an operation of the downhole system, such as during drilling of the subject wellbore 452. For example, as discussed herein, the trajectory manager 128 (and all the associated functions of the data manager 122, escape zone manager 126, etc.) may determine one or more candidate trajectories as a projection below or ahead of the subject wellbore 452 (e.g., ahead of a bit). The projection may be to a threshold distance, such as 200 ft, or may be a projection to a target. In some embodiments, the projection is made at predetermined intervals, such as at every foot. In some embodiments, the projection is made continuously. In this way, the anti-collision workflow described herein may be performed while actively drilling (and intermittently updated) to reduce the risk of collision of the subject wellbore 452 as obstacles are encountered.

In some embodiments, the anti-collision system 120 facilitates implementing a trajectory in connection with the downhole system. For example, the anti-collision system may determine a (e.g., optimal) trajectory and may automatically implement the trajectory. For example, the anti-collision system 120 may communicate the trajectory to a steering system of the downhole system for implementation. In some embodiments, the anti-collision system 120 facilitates implementing the trajectory in combination with user input.

Figures 4, 5:
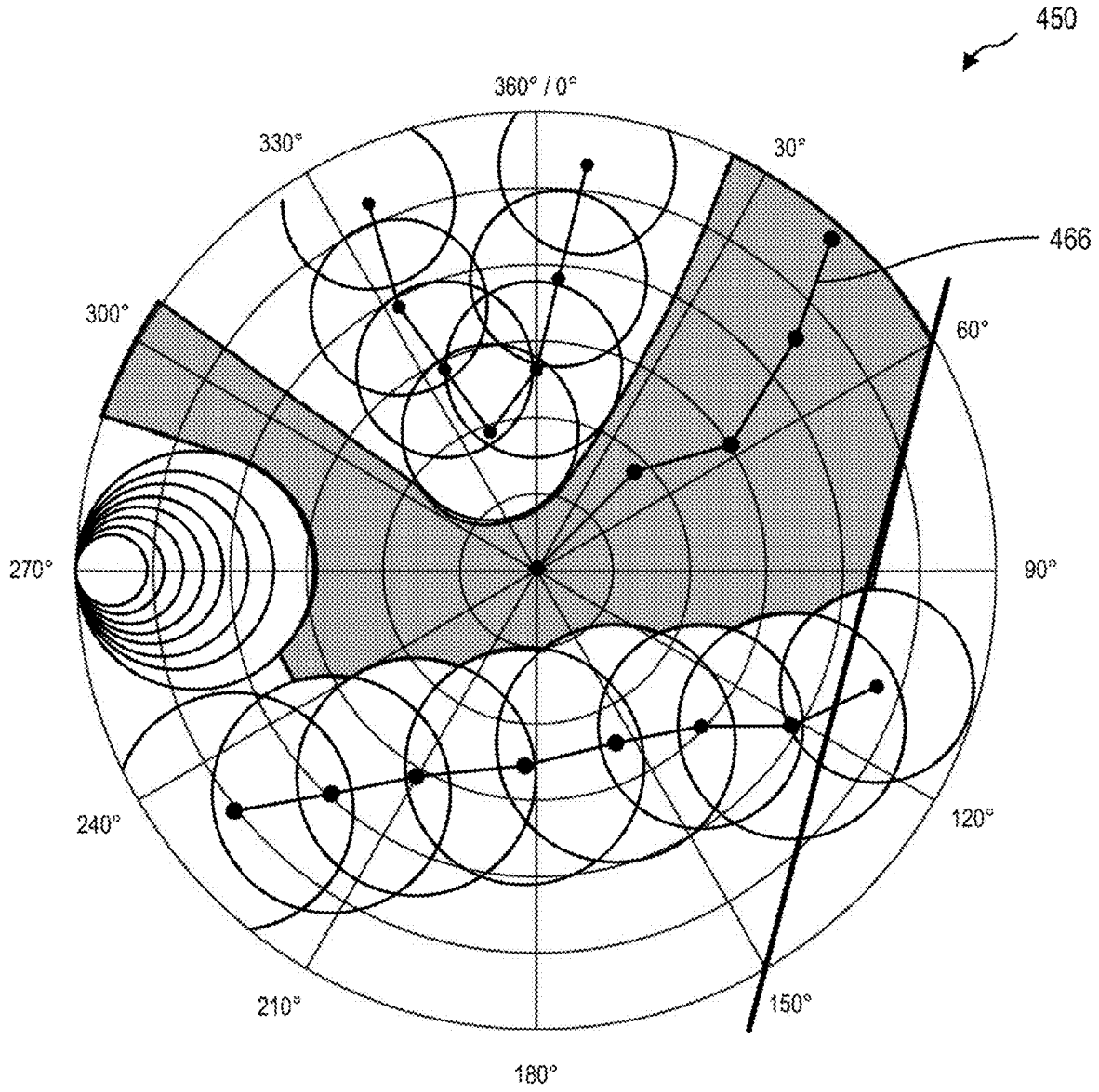
Figures 1, 5:
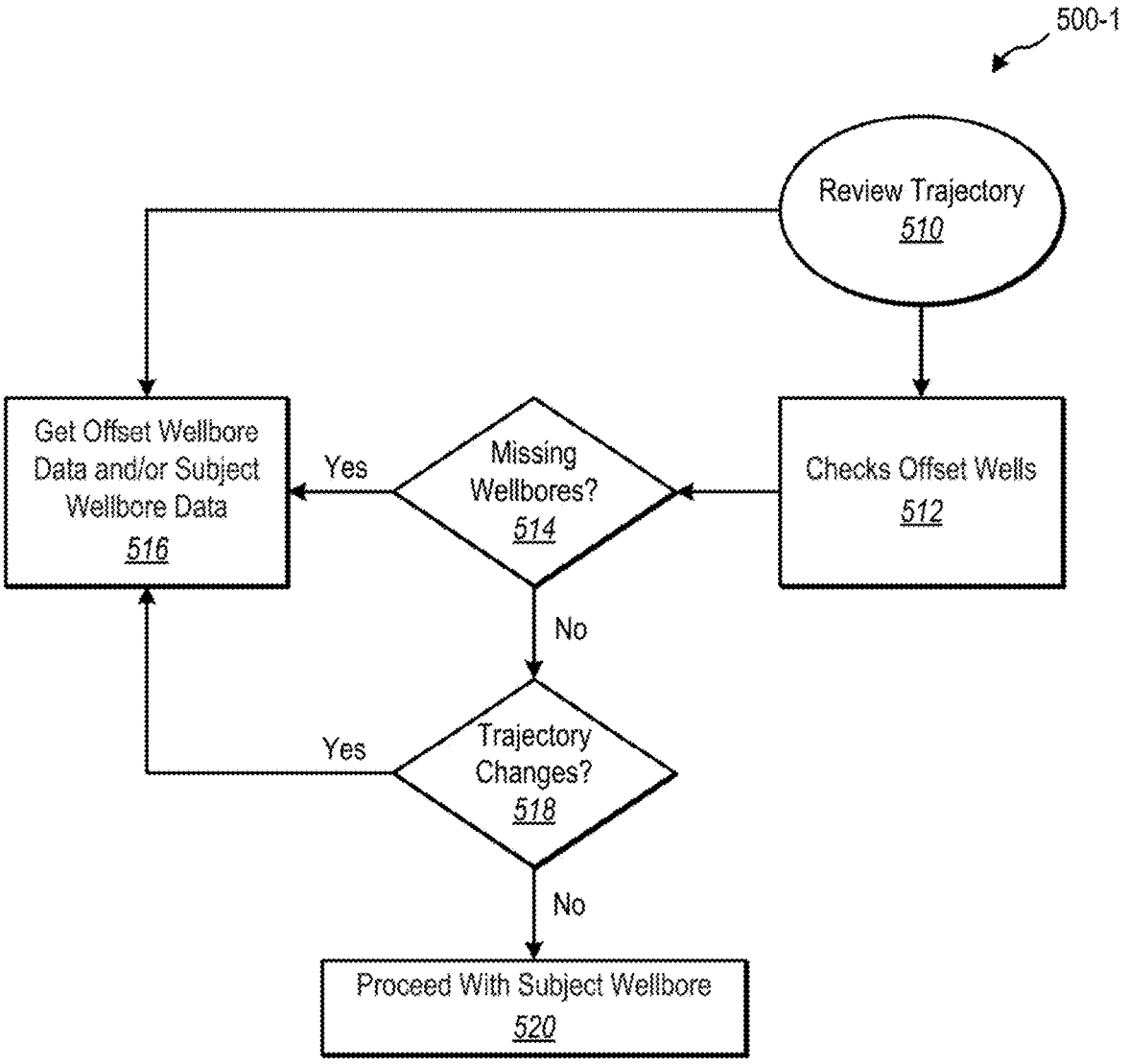
Figures 2, 5:
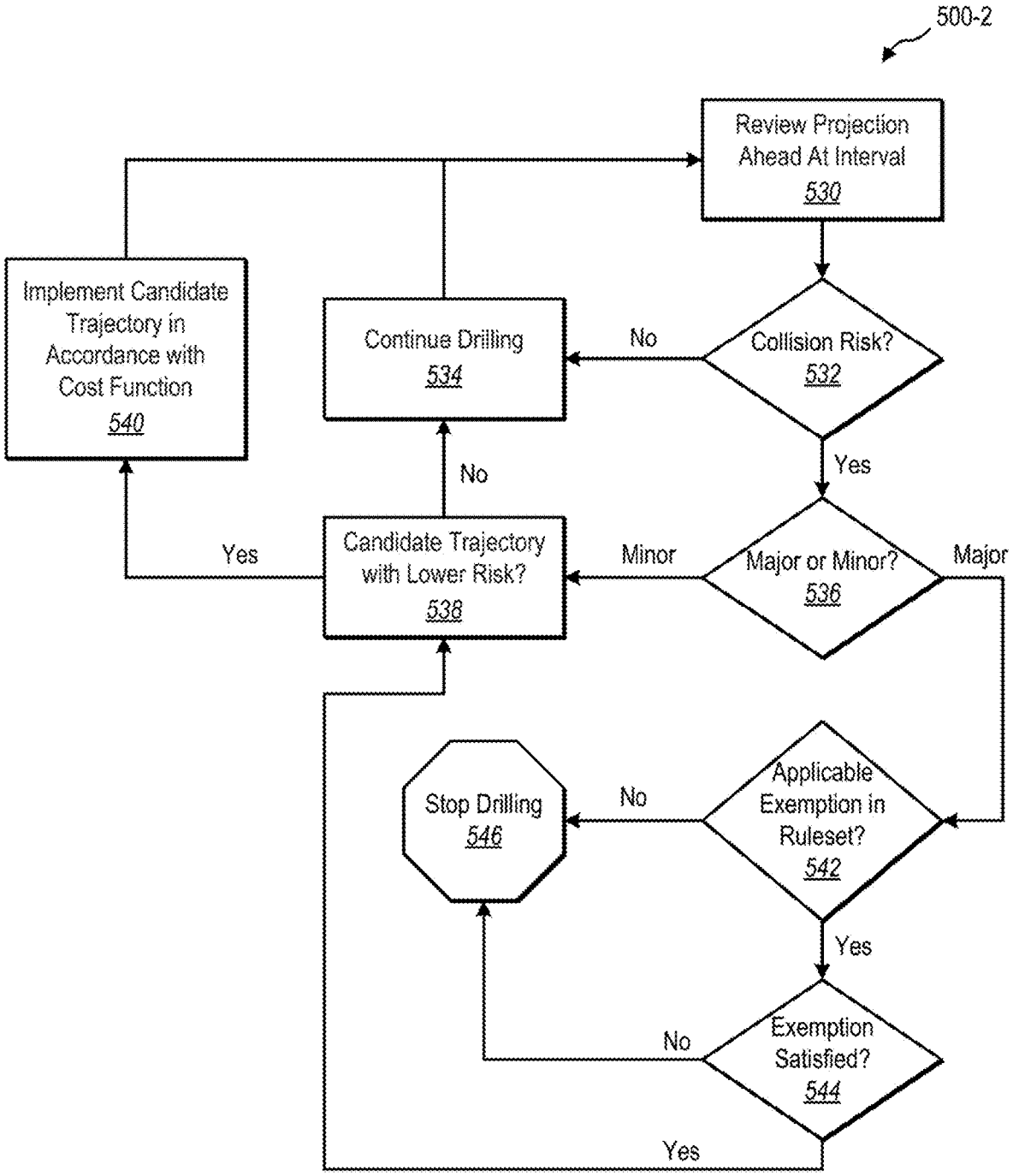

FIG. 5-1 is a flow diagram illustrating an example workflow 500-1 of the anti-collision system 120 as described herein, according to at least one embodiment of the present disclosure. The workflow 500-1 may be implemented by and/or across one or more of the components of the anti-collision system 120 according to that discussed herein.

In planning for the subject wellbore, a planned trajectory may be determined for the subject wellbore to reach and/or access a target such as an underground reservoir. In drilling the subject wellbore, one or more deviations or changes to the planned trajectory may be implemented, such as in response to determined collision risks as discussed above. The anti-collision system 120 may implement the workflow 500-1 to account for one or more changes to the trajectory and/or the anti-collision analysis of the subject wellbore.

At 510, the anti-collision system 120 may review the trajectory of the subject wellbore, including the anti-collision analysis for the associated trajectory. The trajectory may be a planned trajectory (e.g., planned prior to drilling) or may be a trajectory currently being implemented (e.g., currently being drilled). In reviewing the trajectory, the anti-collision system 120 may check for the offset wellbores at 512. For example, the anti-collision system 120 may access the offset wellbore data 138 and/or the subject wellbore data 140. The anti-collision system 120 may review the TC plot, no-go zones, current wellbore trajectory, or any other data. As part of this review, the anti-collision system 120 may verify, at 514, whether the offset wellbores included in the anti-collision analysis (e.g., in the TC plot) of the subject wellbore are still relevant to the current trajectory and/or at the current depth of the subject wellbore. Offset wellbores may be relevant when they are within a threshold proximity to the subject wellbore at one or more (or all) depths, such as at the surface, or at the current MD. If determined that one or more offset wellbores are missing from the current trajectory (e.g., one or more offset wellbores were not accounted for in the associated anti-collision analysis), the anti-collision system may proceed to get additional offset wellbore data 138 at 516. For example, the anti-collision system may access a database of the offset wellbore data 138 to get data pertaining to the (e.g., now) relevant offset wellbores. The anti-collision system 120 may proceed to review the trajectory and/or anti-collision analysis at 510 and may loop through this process until it is determined at 514 that all of the relevant wellbores are now included in the offset wellbore data 138.

When it is determined that no relevant offset wellbores are missing, the anti-collision system may verify whether there have been any changes to the trajectory at 518. Based on changes to the trajectory, the anti-collision system 120 may proceed to get subject wellbore data at 516. For example, the anti-collision system 120 may get the anti-collision analysis for the new trajectory. In some embodiments, the anti-collision system determines the anti-collision analysis for the new trajectory at 516, such as described herein. The anti-collision system 120 may loop through one or more of the acts of the workflow 500-1 until it is determined that the trajectory and associated anti-collision analysis is current and updated. The anti-collision system may then facilitate proceeding with drilling of the subject wellbore at 520. In this way, the anti-collision system may ensure that the data associated with the subject wellbore is updated and relevant.

FIG. 5-2 is a flow diagram illustrating an example workflow 500-2 of the anti-collision system 120 as described herein, according to at least one embodiment of the present disclosure. The workflow 500-2 may be implemented by and/or across one or more of the components of the anti-collision system 120 according to that discussed herein. Additionally, the workflow 500-2 may be implement in connection with, or independent of, the workflow 500-1 of FIG. 5-1. For example, the workflow 500-1 may proceed to the workflow 500-2, or each of the workflows 500-1 and 500-2 may be implemented independently.

The workflow 500-2 may be implemented to analyze and/or account for collision risks as a projection ahead of the subject wellbore. At 530, the anti-collision system 120 may project ahead of the subject wellbore, or may analyze the subject wellbore data 140 and/or the offset wellbore data 138 for a predetermined distance ahead of the subject wellbore (e.g., ahead of a bit). For example, the anti-collision system 120 may project 50 ft., 100 ft., 150 ft., 200 ft., 250 ft., 300 ft, or any other distance (or distance therebetween) ahead of the subject wellbore. In another example, the anti-collision system 120 may project ahead of the bit to a (e.g., next) target for the subject wellbore. In this way, the anti-collision system may operate during drilling of the subject wellbore to account for collision risks in an immediate proximity ahead of a MD of the subject wellbore.

In projecting ahead, the anti-collision system may generate a TC plot, as well as determine safe points and an escape zone for the projection distance, as described herein. At 532, the anti-collision system may determine a collision risk for the current trajectory based on the TC plot (e.g., based on the escape zone). If there is no collision risk, the anti-collision system 120 may facilitate continuing drilling of the subject wellbore according to the current trajectory at 534, such as by implementing the trajectory, or indicating that the trajectory may continue to be followed. A determination of no collision risk may correspond with substantially no collision risk (e.g., 0%), or may correspond with a collision risk below a threshold value. For example, a determination of no collision risk may correspond to a collision risk below 30%, below 20%, below 10%, below 5%, below 1% or any other value (and values therebetween).

If the anti-collision system 120 determines at 532 that there is a collision risk, the anti-collision system 120 may proceed to analyze the collision risk at 536. For example, the anti-collision system 120 may classify or categorize the collision risk as minor or major. A minor collision risk may be a collision risk under a threshold value. For example, a minor collision risk may be a collision risk under 50%, 45%, 40%, 35%, 30%, 25%, or any other value (and values therebetween). A major collision risk may be a collision risk over a threshold value. For example, a major collision risk may be a collision risk over 50%, 60%, 70%, 80%, 90%, 95%, 99%, or any other value (and values therebetween). In this way, a minor collision risk may correspond to a collision risk that is greater than the threshold for a determination of no collision risk, but less than that of a major collision risk. The threshold for a determination of no risk, minor risk, and/or major risk may be defined in one or more applicable rulesets associated with the subject wellbore as described herein. The rulesets may be user defined, system defined, industry standards, or from any other source. Additionally, the anti-collision system may facilitate one or more changes, updates, or overrides of one or more rules of a ruleset in order to provide flexibility to a user of the anti-collision system for performing downhole operations in connection with the subject wellbore. In some embodiments, the anti-collision system 120 determines the collision risk based on a separation factor. For example, the anti-collision system 120 may implement any of a variety of techniques for determining the separation factor, such as determining a perpendicular scan position, a horizontal scan position, a 3D closest approach position. In another example, the anti-collision system 120 may determine the separation factor based on implementing a separation vector method, a pedal curve method, or a scalar/expansion method. The anti-collision system 120 may determine and/or incorporate the separation factor based on any other techniques, such as those known in the industry.

If the collision risk is determined to be minor at 536, the anti-collision system 120 may determine whether there are any candidate or potential trajectories within a lower collision risk at 538. For example, as discussed above, the anti-collision system 120 may determine one or more candidate trajectories within the escape zone of the TC plot for the subject well. The anti-collision system 120 may determine a collision risk for the candidate trajectories. If there are not candidate trajectories with a lower collision risk, the anti-collision system may facilitate continuing to implement the current trajectory at 534 and may ultimately loop back to monitoring the projection ahead at 530. If there are one or more candidate trajectories with a lower risk, the anti-collision system 120 may facilitate changing the current trajectory to implement one of the candidate trajectories at 540. For example, a candidate trajectory with a lowest collision risk may be implemented. In another example, a lower-risk candidate trajectory may be implemented in accordance with the cost function as described herein. For example, the anti-collision system may determine a cost associated with one or more (or each) of the lower-risk candidate trajectories and may determine a trajectory to implement based on the cost function, such as a candidate trajectory with a lowest overall cost. The anti-collision system 120 may accordingly facilitate implementing the selected trajectory and may proceed back to monitoring the projection ahead at 530. In this way, the drilling of the subject well may proceed in the presence of a minor risk while the current trajectory is being analyzed (and potentially while a new trajectory is being determined). Additionally, the anti-collision system 120 may facilitate implementing a trajectory with the lowest collision risk and/or lowest cost during drilling of the subject well.

If the collision risk is determined to be major at 536, the anti-collision system 120 may determine if there is an applicable exemption to the major risk at 542. For example, the anti-collision system 120 may access an applicable or current ruleset (e.g., in the drilling plan) for the subject wellbore and may determine whether the ruleset defines an exemption that applies to the associated major collision risk. If no applicable exemption is identified, the anti-collision system 120 may facilitate stopping drilling at 546. Similarly, the anti-collision system 120 may identify an applicable exemption in the ruleset, at 542 but may determine at 544 that the exemption is not satisfied and may accordingly facilitate stopping drilling at 546. In some embodiments, the anti-collision system 120 automatically stops drilling of the subject wellbore such as through an automated failsafe. In some embodiments, the anti-collision system indicates one or more warnings or alerts to a user to stop drilling operations due to the major collision risk. In this way, drilling of the subject wellbore may be stopped, for example, until measures may be taken to mitigate the major risk. For example, drilling may be stopped in order to determine a new trajectory that avoids the associated risks. In another example, drilling may be stopped in order to validate, overcome, or exempt the associated risk with the current trajectory. Stopping drilling in this way in light of a major risk may be in contrast to, for example, a minor risk, in which collision analysis and trajectory selection may take place while continuing drilling.

An exemption defined by a ruleset may take any of a number of forms. For example, an exemption may exist for a specific offset wellbore and/or no-go zone known or predicted to be inaccurate. In another example, an exemption may exist for proceeding with a collision risk that surpasses the major risk threshold by only a small amount, such as 1%-5%. In another example, an exemption may exist for proceeding with a trajectory if the associated major risk is the least risky of one or more possible alternative trajectories, or if the trajectory is selected by the cost function despite the major risk. In another example, an exemption may take the form of a user overriding a given major risk. An exemption may take the form of any other scenario or rule in accordance with that discussed herein.

For example, exemptions may be generated, documented and or planned for as part of a planning phase of the wellbore. Based on a planning-phase risk analysis, a non-compliance may be identified for the wellbore and/or trajectory design with respect to the no-go zones, lease lines, etc. Documented evidence may be gathered and prepared in order to determine and support a mitigation plan for overcoming the noncompliance. Based on the approval of the mitigation plan, an exemption may be documented and incorporated for overcoming the associated non-compliance if and/or when it is encountered. During operation of the downhole system, the anti-collision system 120 may identify an applicable (e.g., planned) exemption at 542 and may apply the exemption and/or proceed drilling despite the risk, or despite the noncompliance of the trajectory. If the trajectory is determined to violate the exemption, for example, by further exceeding the bounds set by even the exemption, the anti-collision system 120 may facilitate reporting the violation, and stopping the drilling operation if necessary. In this way, exemptions may be implemented into the workflow of the anti-collision system 120 described herein.

If the anti-collision system 120 identifies an applicable exemption at 542, and determines that the exemption is satisfied at 544, the anti-collision system 120 may proceed back to 538 to assess possible candidate trajectories to implement as discussed herein (and continue drilling). In this way, the workflow 500-1 may utilize the features of the anti-collision system discussed herein (e.g., generating TC plots, determining escape zones, determining trajectories, determining collision risks) during drilling of the subject wellbore to incorporate the anti-collision analysis into the steering of the downhole system.

Figure 6:
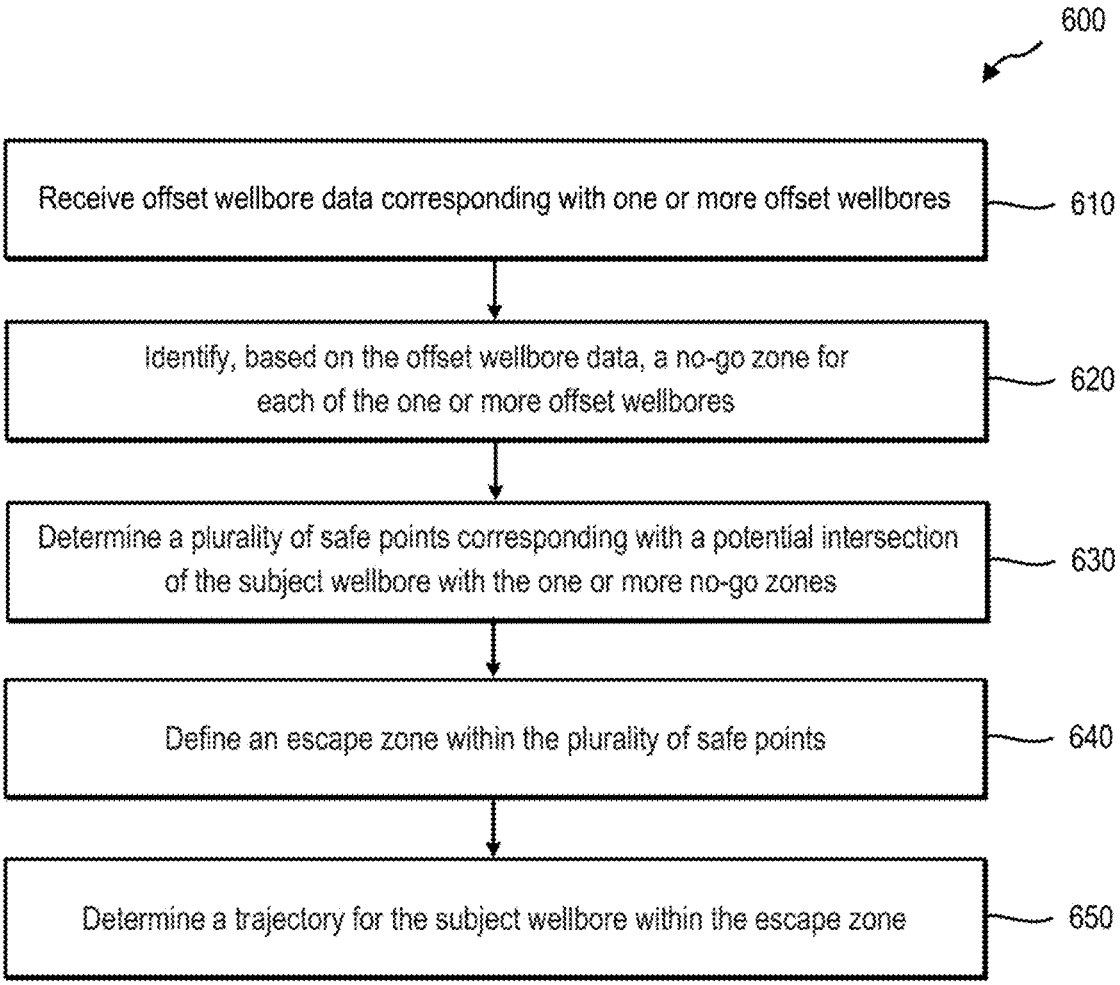
FIG. 6 illustrates a flow diagram for a method or a series of acts for preventing a collision of a subject wellbore in a downhole environment as described herein, according to at least one embodiment of the present disclosure.

FIG. 6 is a flow diagram illustrating a method 600 or a series of acts for preventing a collision of a subject wellbore in a downhole environment as described herein, according to at least one embodiment of the present disclosure. While FIG. 6 illustrates acts according to one embodiment, alternative embodiments may add to, omit, reorder, or modify any of the acts of FIG. 6. Alternatively, a non-transitory computer-readable storage medium may include instructions that, when executed by one or more processors, cause a computing device to perform the acts of FIG. 6. In still further implementations, a system may perform the acts of FIG. 6.

In some embodiments, the method 600 includes an act 610 of receiving offset wellbore data corresponding with one or more offset wellbores. In some embodiments, an anti-collision system updates the offset wellbore data for at least one of the offset wellbores based on a validation of the offset wellbore data during drilling of the subject wellbore. For example, the anti-collision system may adjust (or facilitate adjusting) the no-go zone for at least one of the offset wellbores.

In some embodiments, the method 600 includes an act 620 of identifying, based on the offset wellbore data, a no-go zone for each of the one or more offset wellbores. The no-go zones may correspond to an uncertainty associated with a location of the offset wellbores.

In some embodiments, the method 600 includes an act 630 of determining a plurality of safe points corresponding with a potential intersection of the subject wellbore with the one or more no-go zones. In some embodiments, the anti-collision system selects each safe point from a plurality of candidate safe points based on a proximity to the subject wellbore. For example, the offset wellbore data, including the no-go zones, may be represented in a 2-dimensional coordinate system, such as a traveling cylinder plot, that represents a proximity of the one or more offset wellbores to the subject wellbore at a plurality of depths. The anti-collision system may segment the 2-dimensional coordinate system into a plurality of segments. For each segment, the anti-collision system may determine one or more candidate safe points associated with an intersection of the segment with one or more no-go zones. The anti-collision system may further select a safe point for the segment based on the safe point being a most restrictive of the one or more candidate safe points.

In some embodiments, the method 600 includes an act 640 of defining an escape zone within the plurality of safe points. For example, the anti-collision system may determine the plurality of safe points and may define the escape zone automatically and without user input. In some embodiments, the anti-collision system receives lease line data corresponding to a geographical boundary for the subject wellbore to be drilled, and the anti-collision system further defines the escape zone based on the lease line data.

In some embodiments, the method 600 includes an act 650 of determining a trajectory for the subject wellbore within the escape zone. In some embodiments, the anti-collision system determines a collision risk associated with the trajectory. For example, the collision risk may be determined based on a proximity of the trajectory with the boundary of the escape zone. In some embodiments, the anti-collision system determines a plurality of candidate trajectories within the escape zone and a collision risk for each of the candidate trajectories. The anti-collision system may further select the trajectory from the plurality of candidate trajectories based on the determined collision risks. For example, the anti-collision system may select a trajectory having a lower collision risk than one or more of the candidate trajectories. In another example, the anti-collision system may select a trajectory having a collision risk within a collision risk threshold. In another example, the anti-collision system may select the trajectory based on a cost function incorporating a plurality of factors in addition to the collision risk. In some embodiments, the method 600 is performed while drilling the subject wellbore. In some embodiments, the method 600 includes implementing the trajectory in associated with the subject wellbore.

Figure 7:
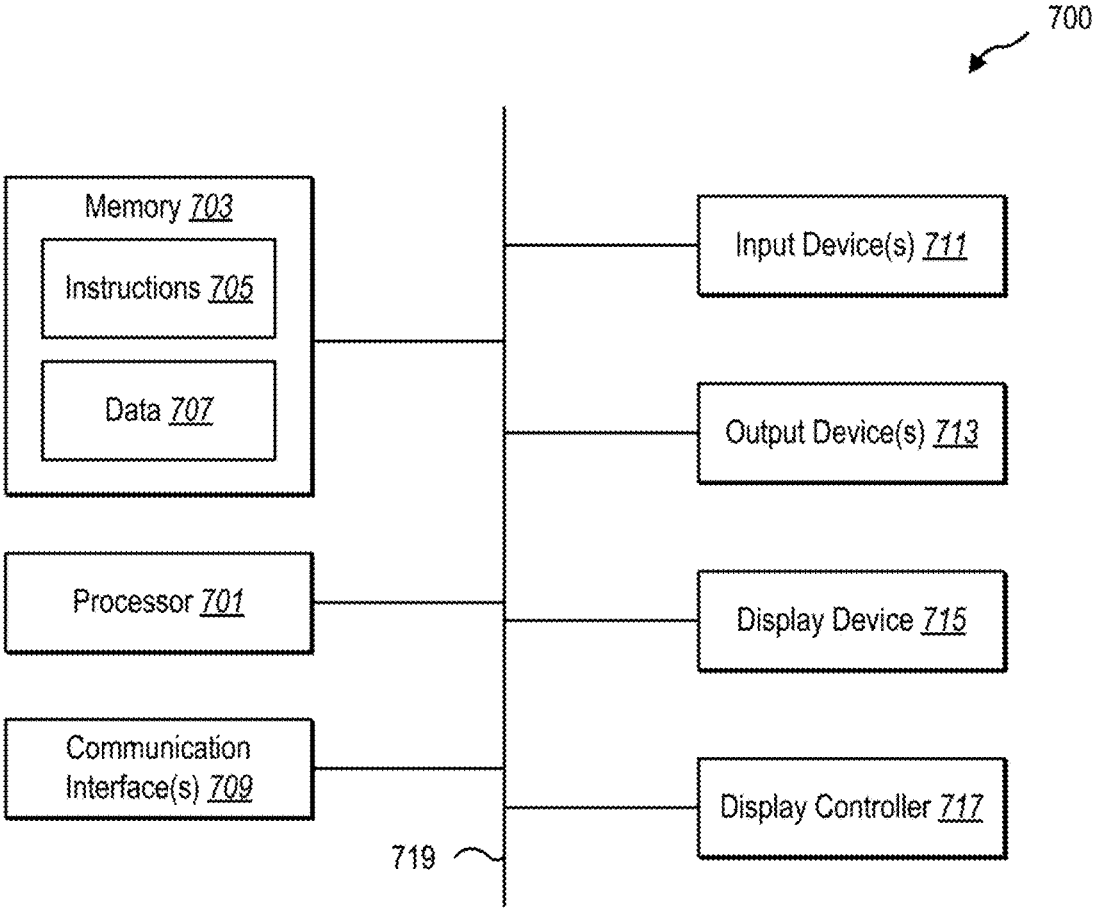
FIG. 7 illustrates certain components that may be included within a computer system.

Turning now to FIG. 7, this figure illustrates certain components that may be included within a computer system 700. One or more computer systems 700 may be used to implement the various devices, components, and systems described herein.

The computer system 700 includes a processor 701. The processor 701 may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor 701 may be referred to as a central processing unit (CPU). Although just a single processor 701 is shown in the computer system 700 of FIG. 7, in an alternative configuration, a combination of processors (e.g., an ARM and DSP) could be used.

The computer system 700 also includes memory 703 in electronic communication with the processor 701. The memory 703 may include computer-readable storage media and may be any available media that may be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure may comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which may be used to store program code in the form of computer-executable instructions or data structures and which may be accessed by a general purpose or special purpose computer, whether such program code is stored or in software, hardware, firmware, or combinations thereof.

Instructions 705 and data 707 may be stored in the memory 703. The instructions 705 may be executable by the processor 701 to implement some or all of the functionality disclosed herein. Executing the instructions 705 may involve the use of the data 707 that is stored in the memory 703. Any of the various examples of modules and components described herein may be implemented, partially or wholly, as instructions 705 stored in memory 703 and executed by the processor 701. Any of the various examples of data described herein may be among the data 707 that is stored in memory 703 and used during execution of the instructions 705 by the processor 701.

A computer system 700 may also include one or more communication interfaces 709 for communicating with other electronic devices. The communication interface(s) 709 may be based on wired communication technology, wireless communication technology, or both. Some examples of communication interfaces 709 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces 709 may connect the computer system 700 to a network. A "network" or "communications network" may generally be defined as one or more data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media may include a communication network and/or data links, carrier waves, wireless signals, and the like, which may be used to carry desired program or template code means or instructions in the form of computer-executable instruction or data structures and which may be accessed by a general purpose or special purpose computer.

A computer system 700 may also include one or more input devices 711 and one or more output devices 713. Some examples of input devices 711 include a keyboard, mouse, microphone, remote control device, button, joystick, trackball, touchpad, and lightpen. Some examples of output devices 713 include a speaker and a printer. One specific type of output device that is typically included in a computer system 700 is a display device 715. Display devices 715 used with embodiments disclosed herein may utilize any suitable image projection technology, such as liquid crystal display (LCD), light-emitting diode (LED), gas plasma, electroluminescence, or the like. A display controller 717 may also be provided, for converting data 707 stored in the memory 703 into text, graphics, and/or moving images (as appropriate) shown on the display device 715.

The various components of the computer system 700 may be coupled together by one or more buses, which may include a power bus, a control signal bus, a status signal bus, a data bus, etc. For the sake of clarity, the various buses are illustrated in FIG. 7 as a bus system 719.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures may be transferred automatically or manually from transmission media to non-transitory computer-readable storage media (or vice versa). For example, computer executable instructions or data structures received over a network or data link may be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media may be included in computer system components that also (or even primarily) utilize transmission media.

INDUSTRIAL APPLICABILITY

In some embodiments, a downhole system is configured for drilling an earth formation to form a wellbore 102. The downhole system includes a drill rig used to turn a drilling tool assembly which extends downward into the wellbore. The drilling tool assembly may include a drill string 105, a bottomhole assembly ("BHA"), and a bit to the downhole end of the drill string.

The drill string may include several joints of drill pipe connected end-to-end through tool joints. The drill string transmits drilling fluid through a central bore and transmits rotational power from the drill rig to the BHA. In some embodiments, the drill string further includes additional downhole drilling tools and/or components such as subs, pup joints, etc. The drill pipe provides a hydraulic passage through which drilling fluid is pumped from the surface. The drilling fluid discharges through selected-size nozzles, jets, or other orifices in the bit for the purposes of cooling the bit and cutting structures thereon, and for lifting cuttings out of the wellbore as it is being drilled.

The BHA may include the bit, other downhole drilling tools, or other components. An example BHA may include additional or other downhole drilling tools or components (e.g., coupled between to the drill string and the bit). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the downhole system may include other downhole drilling tools, components, and accessories such as special valves (e.g., kelly cocks, blowout preventers, and safety valves). Additional components included in the downhole system may be considered a part of the drilling tool assembly, the drill string, or a part of the BHA, depending on their locations in the downhole system.

The bit in the BHA may be any type of bit suitable for degrading downhole materials. For instance, the bit may be a drill bit suitable for drilling the earth formation. Example types of drill bits used for drilling earth formations are fixed-cutter or drag bits. In other embodiments, the bit may be a mill used for removing metal, composite, elastomer, other materials downhole, or combinations thereof. For instance, the bit may be used with a whipstock to mill into casing lining the wellbore. The bit may also be a junk mill used to mill away tools, plugs, cement, other materials within the wellbore, or combinations thereof. Swarf or other cuttings formed by use of a mill may be lifted to the surface, or may be allowed to fall downhole. The bit may include one or more cutting elements for degrading the earth formation.

The BHA may further include a rotary steerable system (RSS). The RSS may include directional drilling tools that change a direction of the bit, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit, change the course of the bit, and direct the directional drilling tools on a projected trajectory. The RSS may steer the bit in accordance with or based on a trajectory for the bit. For example, a trajectory may be determined for directing the bit toward one or more subterranean targets such as an oil or gas reservoir.

The downhole system may be operated in accordance with a drilling plan. For example, a drilling plan may include instructions, plans, procedures, designs, objectives etc. for directing the operation of the various subsystems, processes, and objectives of the downhole system.

The downhole system may include one or more client devices with an anti-collision system implemented thereon (e.g., implemented on one, several, or across multiple client devices). The anti-collision system may facilitate determining and incorporating one or more trajectories and/or changes to trajectories of the downhole system. For example, the downhole system may be implemented at a location where one or more existing wellbores (e.g., offset wellbores) are adjacent or near to a subject wellbore associated with (e.g., being or to be drilled by) the downhole system. The anti-collision system may facilitate determining and/or selecting one or more trajectories such that the subject wellbore does not intersect or collide with any of the offset wellbores.

In some embodiments, an example environment in which an anti-collision system is implemented in accordance with one or more embodiments describe herein. The environment includes one or more server device(s). The server device(s) may include one or more computing devices (e.g., including processing units, data storage, etc.) organized in an architecture with various network interfaces for connecting to and providing data management and distribution across one or more client systems. The server devices may be connected to and may communicate with (either directly or indirectly) one or more client devices through a network. The network may include one or multiple networks and may use one or more communication platforms or technologies suitable for transmitting data. The network may refer to any data link that enables transport of electronic data between devices of the environment. The network may refer to a hardwired network, a wireless network, or a combination of a hardwired network and a wireless network. In one or more embodiments, the network includes the internet. The network may be configured to facilitate communication between the various computing devices via well-site information transfer standard markup language (WITSML) or similar protocol, or any other protocol or form of communication.

The client device may refer to various types of computing devices. For example, one or more client devices may include a mobile device such as a mobile telephone, a smartphone, a personal digital assistant (PDA), a tablet, a laptop, or any other portable device. Additionally, or alternatively, the client devices may include one or more non-mobile devices such as a desktop computer, server device, surface or downhole processor or computer (e.g., associated with a sensor, system, function, etc. of the downhole system), or other non-portable device. In one or more implementations, the client devices include graphical user interfaces (GUI) thereon (e.g., a screen of a mobile device). In addition, or as an alternative, one or more of the client devices may be communicatively coupled (e.g., wired or wirelessly) to a display device having a graphical user interface thereon for providing a display of system content. The server devices(s) may similarly refer to various types of computing devices. Each of the devices of the environment may include features and functionalities described below.

The environment may include an anti-collision system implemented on one or more computing devices. The anti-collision system may be implemented on one or more client device, server devices, and combinations thereof. Additionally, or alternatively, the anti-collision system may be implemented across the client devices and the server devices such that different portions or components of the anti-collision system are implemented on different computing devices in the environment. In this way, the environment may be a cloud computing environment, and the anti-collision system may be implemented across one or more devices of the cloud computing environment in order to leverage the processing capabilities, memory capabilities, connectivity, speed, etc. that such cloud computing environments offer in order to facilitate the features and functionalities described herein.

In some embodiments, the anti-collision system may include a data manager, a report engine, an escape zone manager, a trajectory manager, and a cost function engine. The anti-collision system may also include a data storage having offset wellbore data, and subject wellbore data, stored thereon. While one or more embodiments described herein describe features and functionalities performed by specific components of the anti-collision system, it will be appreciated that specific features described in connection with one component of the anti-collision system, in some examples, is performed by one or more of the other components of the anti-collision system.

By way of example, one or more of the data receiving, gathering, and/or storing features of the data manager may be delegated to other components of the anti-collision system. As another example, while safety points and tolerance lines may be determined by the escape zone manager, in some instances, some or all of these features may be performed by the trajectory manager (or other component of the anti-collision system). Indeed, it will be appreciated that some or all of the specific components may be combined into other components and specific functions may be performed by one or across multiple of the components of the anti-collision system.

Additionally, while one or more features of the anti-collision system have been described as implemented on a client device of the downhole system, it should be understood that some or all of the features and functionalities of the anti-collision system may be implemented on or across multiple client devices and/or server devices. For example, one or more trajectories may be determined by the trajectory manager on a (e.g., local) client device, and a trajectory may be selected by the cost function engine on a remote, server, and/or cloud device. Indeed, it will be appreciated that some or all of the specific components may be implemented on or across multiple client devices and/or server devices, including individual functions of a specific component being performed across multiple devices.

As mentioned above, the anti-collision system includes a data manager. The data manager may receive and manage a variety of types of data of the anti-collision system. For example, the data manager may receive offset wellbore data. The offset wellbore data may correspond to one or more existing wellbores or offset wellbores, such as within a threshold proximity to a subject wellbore. For example, the offset wellbores may be wellbores that are in a same oil/gas field, basin, formation, geographic location, etc. as the subject wellbore. The offset wellbore data may include information regarding each of these offset wellbores. For example, the offset wellbore data may include information regarding the offset wellbores' geometry, trajectory, geological and geophysical information, well completion and production information, directional surveys, wellbore integrity, wellbore stability, wellbore control, drill string integrity during the construction of that wellbore, drilling logs, formation evaluation logs, operational reports, any other information associated with the offset wellbores, and combinations thereof.

In some embodiments, the offset wellbore data includes a buffer, threshold, or no-go zone associated with the location, geometry, and/or trajectory of each offset wellbore (at one or more or all depths of the offset wellbores). For example, the no-go zone may be a circle, ellipsoid, or any other shape which may outline an area of a known or predicted location of the offset wellbore (at one or more depths), such as the no-go zones. In some embodiments, the no-go zone represents an uncertainty associated with the offset wellbore. For example, an exact or precise location of the offset wellbore at one or more depths may be unknown or uncertain. The uncertainty may be due to unreliable, incomplete, nonexistent, or otherwise insufficient data, such as due to an age of the offset wellbore or due to a type of measurement tool that was used. The no-go zone may outline an area where the offset wellbore is expected or predicted to be to a certain degree (e.g., in contrast to representing an exact location of the wellbore with a single point for example). Put another way, an exact position of the offset wellbore may be uncertain, and the offset wellbore may be expected or predicted to be somewhere within the associated no-go zone within a threshold (e.g., percentage of) certainty. For example, an offset wellbore having a greater uncertainty may have a larger associated no-go zone (e.g., larger radius), and an offset wellbore having a smaller uncertainty may have a smaller associated no-go zone (e.g., smaller radius). In this way, the no-go zones may represent areas that present a level of risk for colliding with or intersecting an existing, offset wellbore.

In some embodiments, the data manager receives one or more no-go zones associated with the offset wellbores. For example, the offset wellbore data may be maintained in a central database (e.g., in the server device) and the no-go zones may be maintained in the database as well. In some embodiments, the data manager calculates and/or determines one or more no-go zones. For example, the no-go zones may be determined based on the offset wellbore data in connection with one or more established industry standards (e.g., ISCWSA standards), client standards, user defined parameters, etc. The data manager may upload and/or maintain the no-go zones in the database.

In some embodiments, the data manager updates and/or modify the offset wellbore data in the database, including the no-go zones, as described herein. In some embodiments, while drilling the subject wellbore, information is gathered regarding one or more offset wellbores. For example, downhole measurement tools may detect the presence (or lack thereof) and location of an offset wellbore. The data manager may accordingly update the offset wellbore data. In another example, the no-go zone for a particular offset wellbore may outline or encompass a given area, and the subject wellbore may be made to successfully pass through that area (e.g., an operator may override a no-go zone such as based on their knowledge and/or experience). The data manager may accordingly update the offset wellbore data to reflect that the offset wellbore was not in that location. The data manager may modify and/or update the offset wellbore data automatically and/or based on user input.

In some embodiments, the data manager refines the offset wellbore data. For example, the offset wellbore data may indicate that an offset wellbore is located near the subject wellbore, but the data may not be sufficient to verify a location, establish a no-go zone, etc. for the offset wellbore. The data manager may accordingly get additional information to supplement the offset wellbore data in order to establish a location, no-go zone, etc. for that offset wellbore. For example, the data manager may search one or more additional devices or databases for additional data related to the offset wellbore. In another example, the data manager may facilitate taking one or more measurements or surveys regarding the offset wellbore in order to supplement the offset wellbore data, such as indicating to or prompting a user for the measurements. The data manager may refine the offset wellbore data automatically and/or based on user input.

In some embodiments, the data manager requests or receives additional offset wellbore data. For example, the data manager may initially receive offset wellbore data for offset wellbores near the subject well. As the offset wellbore is drilled and/or if a trajectory or plan of the offset wellbore is changed, additional offset wellbores may become relevant (e.g., be positioned near) to the subject wellbore. Similarly, one or more of the offset wellbores may no longer be relevant (e.g., may be directed away from) the subject wellbore. The data manager may accordingly receive additional wellbore data regarding the additional relevant offset wellbores, and/or may disregard offset wellbore data regarding the no longer relevant offset wellbores. This may be based on user input and/or may be performed automatically (e.g., with little or no user input) by the data manager.

In some embodiments, the data manager creates new offset wellbore data 138. For example, information may be gathered during drilling of the subject wellbore (e.g., sensor data, drilling logs, steering information, etc.). The data manager may receive and store this information as offset wellbore data for use in future drilling operations. In this way, the subject wellbore may, in the future, become an offset wellbore for a future wellbore, and the data manager may accordingly maintain the offset wellbore data with this information regarding the (e.g., current) subject wellbore.

In some embodiments, the data manager receives a drilling plan. The drilling plan may include one or more objectives of the subject wellbore such as a type, location, etc. of a target well or target reservoir. The drilling plan may include or may outline one or more procedures for drilling the subject wellbore. The drilling plan may include one or more planned or potential trajectories for the subject wellbore to access a target reservoir. In some embodiments, the drilling plan includes one or more rulesets for drilling the subject wellbore (e.g., for implementing a trajectory). For example, the rulesets may include or may define one or more thresholds for assessing collision risks of the subject wellbore as well as exceptions for proceeding when presented with risks, as described herein. The rulesets may define a threshold distance (e.g., feet), as well as a frequency, to project or analyze, for example, ahead of a bit to assess collision risks for the subject wellbore, as described herein. The rulesets may define an allowable deviation from a planned trajectory of the subject wellbore. The rulesets may include rules for determining and/or modifying no-go zones as described herein. In some embodiments, the rules of the rulesets are defined by one or more industry standards, client defined standards, operator defined parameters or procedures, any other rules, and combinations thereof.

In some embodiments, the data manager receives lease line data corresponding with a geographic location for the subject wellbore to be drilled. For example, the subject wellbore may be associated with a specific area of real property which is leased for the purpose of drilling the subject well. The downhole system may be subject to one or more legal requirements to maintain the subject wellbore within certain geographic boundaries or lease lines. The data manager may receive lease lines associated with one or more of these geographic boundaries.

In some embodiments, the data manager receives sensor data. The sensor data may include measurements from any number of sensors included or associated with the downhole system. For example, the sensor data may include measurements from reservoir mapping tools, formation evaluation tools, logging while drilling (LWD) tools, measurement while drilling (MWD) tools, and/or Gyro while Drilling (GWD) tools. The sensor data may include measurements from downhole sensors and surfaces sensors. The sensor data may include measurements from gamma ray sensors, resistivity sensors, neutron density sensors, nuclear magnetic resonance sensors, porosity sensors, acoustic sensors, temperature sensors, pressure sensors, depth sensors, any other sensor, and combinations thereof. The sensor data may include data from one or more surveying tools. The data manager may receive the sensor data from any sensor in communication with the downhole system.

In some embodiments, the data manager receives user input. The data manager may receive the user input, for example, via any of the client devices and/or server devices. Any of the data described herein may be input or augmented via the user input. For example, in some instances, some or all of the sensor data is received by the data manager as user input. In some instances, some or all of the lease line data is received by the data manager as user input. As will be described herein, the user input may be received in associated with one or more functions or features of the anti-collision system, such as part of determining and/or selecting a trajectory, or as part of evaluating and proceeding with collision risk. In this way, the data manager may receive the user input to the anti-collision system.

The data manager may save and/or store any of the data it receives to the data storage. For example, the data manager may store data associated with or pertaining to one or more offset wellbores as offset wellbore data. The data manager may receive some or all of the wellbore data as discussed above, and may also generate, save, and/or store any additional data as wellbore data. The data manager may store data associated with the subject wellbore as subject wellbore data. For example, some or all of the drilling plan, lease line data, sensor data, etc. may be saved as subject wellbore data.

As mentioned above, the anti-collision system includes a report engine. The report engine may generate one or more reports. In some embodiments, the report engine generates one or more plots. For example, the report engine may generate a TC plot. The report engine may aggregate data from the offset wellbore data and/or the subject wellbore data to generate the TC plot. The TC plot may be a 2-dimensional plot that may represent 3-dimensional aspects of the subject wellbore and one or more offset wellbores. For example, the center or origin of the TC plot may represent a position or location of the subject wellbore, such as a bottom or measurement depth (MD) of the subject wellbore (e.g., at bit or BHA of the downhole system). The TC plot may be a representation of a plane perpendicular or normal to the subject wellbore. In this way the TC plot may conceptually represent, in 2-dimensional space, a perspective or view from the subject wellbore of one or more surrounding features (e.g., offset wellbores). For example, the TC plot may represent a projection of a given distance ahead of the subject wellbore. In some embodiments, one or more TC plots may be generated to represent projections at various distances ahead of the subject wellbore.

The TC plot may include one or more offset wellbores. The offset wellbores may be represented by one or more points connected by a line. The points of the offset wellbores may represent the location of the offset wellbores at different depths of the offset wellbores. A proximity of the points and/or line of the offset wellbores to the origin of the TC plot may represent a proximity of the offset wellbores to the subject wellbore. The TC plot may include one or more no-go zones for the offset wellbores. In some embodiments, the TC plot includes a representation of one or more lease lines associated with the subject wellbore, as described herein.

In some embodiments, the report engine plots one or more safe points, tolerance lines, escape zones, and/or trajectories on the TC plot, as discussed herein. In some embodiments, the report engine presents the TC plot via a graphical user interface, for example, to a user of the anti-collision system. The report engine may store the TC plot to the data storage as subject wellbore data.

As mentioned above, the anti-collision system includes an escape zone manager 126. The escape zone manager may facilitate identifying one or more escape zones, or areas and/or directions in which the subject wellbore may have less risk of collision with an offset wellbore.

In some embodiments, the escape zone manager receives or accesses the TC plot from the data storage. The escape zone manager may segment the TC plot into one or more segments. The segments may be defined by a line from the origin to the perimeter of the TC plot. In this way, the segments may represent a division of the TC plot into one or more angles in a sequential rotation around the origin.

In some embodiments, the escape zone manager identifies the no-go zones associated with each of the offset wellbores (e.g., from the offset wellbore data). For each of the segments, the escape zone manager may determine each intersection of the segment with a boundary of the no-go zones. These intersections may define one or more candidate safe points for the segment (e.g., one or more potential intersections of the subject wellbore with the no-go zones). From the candidate safe points, the escape zone manager may determine which of the candidate safe points is closest to the origin (e.g., to the subject wellbore) and may select this candidate safe point as the safe point for the segment. In this way, the safe point for the segment may represent a potential intersection (or collision) of the subject wellbore with an offset wellbore that is closest to the subject wellbore for that segment. Put another way, the safe point for the segment may be a most restrictive proximity to the subject wellbore when compared to all of the plurality of candidate safe points. The escape zone manager may select a safe point in this manner for each of the segments of the TC plot, for example, by sequentially sweeping around the TC plot. In this way, the escape zone manager may be selected a plurality of safe points that substantially represent an entire revolution around the TC plot. The escape zone manager may store the safe points to the data storage as part of the subject wellbore data. The safe points may be plotted on the TC plot, for example, by the report engine.

In some embodiments, the escape zone manager determines one or more tolerance lines. For example, the tolerance lines may be lines between safe points of adjacent segments. The tolerance lines may accordingly connect all of the safe points into an enclosed area, or escape zone. The escape zone may represent a direction or area in which the subject wellbore may be directed that is substantially free of potential collisions with the offset wellbores. In some embodiments, the escape zone manager determines the escape zone based on user input. For example, the escape zone manager may present the safe points, the tolerance lines, and/or the escape zone to a user, such as via a GUI. The escape zone manager may facilitate the user modifying, adjusting, or otherwise changing one or more of the safe points, the tolerance lines and/or the escape zone.

In some embodiments, the escape zone manager incorporates one or more lease lines into the workflow just described. For example, the escape zone manager may identify a geological boundary associated with a leased plot of land (e.g., from the subject wellbore data), and may accordingly generate one or more lease lines. The escape zone manager may determine candidate safe points associated with the lease lines based on intersections of each segment with the lease lines in a similar manner to the no-go zones. In this way, the escape zone manager may further define (or limit) the escape zone based on the lease lines to facilitate maintaining the subject wellbore within an associated geographical boundary. The escape zone manager may store the tolerance lines, lease lines, and escape zone to the data storage as part of the subject wellbore data. Additionally, the report engine may plot any of the tolerance lines, lease lines, and escape zone to the TC plot.

In this way, the anti-collision system may identify one or more offset wellbores (and/or lease lines) as potential obstacles for the subject wellbore to avoid, may determine boundaries (e.g., tolerance lines) around the potential obstacles, and may define a safe area (e.g., escape zone) or direction for the subject wellbore to proceed. In some embodiments, the anti-collision system performs these functionalities automatically and without user input. This may be in contrast to conventional techniques, which typically rely heavily on operator-defined boundaries and thresholds, as well as operator interpretation of the subject wellbore's trajectory in relation to obstacles such as offset wellbores. Such techniques may be labor intensive, slow, and/or may be prone to human error. In this way, the anti-collision system may be advantageous by providing automated, quick, and accurate anti-collision analysis for the subject wellbore.

As mentioned above, the anti-collision system may include a trajectory manager. The trajectory manager may facilitate determining one or more trajectories for avoiding collisions with the offset wellbores. For example, the trajectory manager may receive or access the TC plot from the data storage, including the safe points, escape zone, etc. described herein. Based on the TC plot, the trajectory manager may identify one or more candidate trajectories for the subject wellbore within the escape zone. For example, the trajectory manager may identify an area from about 20° to about 90° as an area substantially free of obstacles, and may determine one or more candidate trajectories for directing the subject wellbore in that general direction. In another example, the trajectory manager may identify an area around about 330° as a potential direction for the subject wellbore to proceed for potentially avoiding obstacles, and may accordingly determine one or more candidate trajectories in that general direction. In some embodiments, the trajectory manager determines one or more candidate trajectories based on user input. For example, the trajectory manager may present the TC plot and/or the associated escape zone to a user and may facilitate the user determining one or more candidate trajectories. In another example, the trajectory manager may present one or more candidate trajectories, and may facilitate a user selecting a trajectory from the candidate trajectories. In another example, the trajectory manager may facilitate a user modifying, adjusting, and/or changing one or more candidate trajectories. In some embodiments, the report engine plots one or more candidate trajectories on the TC plot.

In some embodiments, the trajectory manager evaluates a collision risk (e.g., a percentage) associated with one or more of the candidate trajectories. For example, the trajectory manager may determine the risk of the subject well colliding with an offset well (or crossing a lease line) for a given trajectory based on a proximity of the subject well to the tolerance lines, no-go zones, etc. A trajectory that approaches closer to the boundary of the escape zone may be assigned a higher risk percentage and a trajectory that does not closely approach the boundary may be assigned a lower risk percentage. In some embodiments, the trajectory manager determines one or more candidate trajectories automatically. In some embodiments, the trajectory manager facilitates determining one or more candidate trajectories, for example, based on user input.

In some embodiments, the trajectory manager facilitates selecting a trajectory from the candidate trajectories. For example, the trajectory manager may present several candidate trajectories to a user, and a trajectory may be selected based on input from the user. In some embodiments, the trajectory manager may observe and/or discern a behavioral preference of the user based on these interactions. For example, the trajectory manager may observe that the user tends to strictly adhere to the determined constraints such as the no-go zones, escape zone, etc. In another example, the trajectory manager may observe that the user tends to forgo or override one or more determined constraints and/or types of constraints. In some embodiments, the trajectory manager learns these behavioral preferences and accordingly determines and/or presents one or more trajectories based on incorporating these user preferences. In some embodiments, the trajectory manager automatically selects a trajectory without any user input. For example, the trajectory manager may determine several (or all) candidate trajectories for the subject well within the escape zone and may select a trajectory that has a lowest (or no) collision risk. The trajectory manager may store the selected trajectory to the data storage as subject wellbore data.

In some embodiments, the trajectory manager determines one or more candidate trajectories, but does not select a trajectory. For example, as mentioned above, the anti-collision system may include a cost function engine which may facilitate selecting a trajectory. The cost function engine may receive or may access, from the trajectory manager, one or more candidate trajectories and the associated collision risks. For example, the cost function engine may receive a predetermined quantity of candidate trajectories such as a quantity of trajectories having a lowest associated collision risk. In another example, the cost function engine may receive all candidate trajectories within the escape zone having an associated risk within a predetermine threshold. In another example, the cost function engine may receive all candidate trajectories within the escape zone. In some embodiments, the cost function engine selects a trajectory based on the trajectory having a lowest (or no) collision risk.

In some embodiments, the cost function engine selects a trajectory based on factors in addition to the anti-collision analysis/collision risk. For instance, in some cases a candidate trajectory that is determine based on the escape zone may not be practical or desirable based on other factors. For example, a candidate trajectory may be determined to have a low (or lowest) collision risk but may implement a geometry that is not suitable for the drilling tool assembly, such as a high dogleg or a high number of turns or curves. In another example, a clearer or less crowded area of the escape zone may be in a direction that is oriented away from a target or planned direction for the subject wellbore, and accordingly a candidate trajectory leading in that direction may not be desirable for implementing for the subject wellbore.

In some embodiments, the cost function engine implements a cost function for considering and weighing a variety of factors in order to select an optimal or advantageous trajectory based on more than just the collision risk. For example, the cost function may account for properties such as one or more of trajectory length, steering length, average steering ratio, maximum steering ratio, average deviation, maximum deviation, snaking, steering risk, angular deviation, endpoint distance, endpoint angle, target forward, number of curves, directional difficulty index (DDI), any other parameter, and combinations thereof. The cost function engine 130 may determine a normalized cost value $C_i$ of each of the properties. The normalized cost value $C_i$ may be a value between 0 and 1. Each property may have a context-dependent weight factor $W_i$ representing a relative importance of the property. In some embodiments, one or more parameters are constrained by an associated boundary or limit, and a penalty $P_k$ is applied for each violating the limit. A weight $V_k$ may be applied to the penalty $P_k$ (e.g., for violating the limit) representing a relative severity or importance of the limit. The cost function engine 130 may determine or calculate any of these values and/or may receive and/or modify any of these values, such as based on user input. A total cost $C_{tot}$ for a candidate trajectory may therefore be determined by the following formula:

$$C_{tot} = \sum_i C_i W_i + \sum_k V_k P_k$$

In this way, the collision risk of the candidate trajectory may be determined and provided to the cost function engine as one of a number of factors to consider when evaluating and selecting a trajectory.

In some embodiments, the cost function engine is implemented as a cloud computing component of the anti-collision system. For example, the various parameters may be received (e.g., to a server device) from a variety of sources and/or devices, and the cost function engine may be implemented in one or more cloud computing resources in order to analyze the parameters and/or implement the cost function. In some embodiments, the cost function engine is implemented in the anti-collision system in connection to one or more (e.g., distinct) systems associated with the downhole system and/or the subject wellbore. For example, the anti-collision system may provide the candidate trajectories and associated collision risks to another system for implementing the cost function engine. In this way, some or all of the functionalities of the cost function engine may be performed by a separate (e.g., or higher tiered) system in communication with the anti-collision system. For example, the anti-collision system may be a subsystem of a greater downhole computing system for determining and implementing trajectories, and the greater system may implement the cost function engine in or across one or more systems or components in addition to the anti-collision system. In this way, the anti-collision system (and the cost function engine) may leverage the capabilities of cloud computing resources in order to provide, fast, robust, and complete computations and information, for example, in order to facilitate making informed decisions regarding implementing a potential trajectory for the subject wellbore.

In some embodiments, the anti-collision system performs one or more of the features described herein for an entirety of a length of the subject wellbore. This may be as part of a planning phase for the subject wellbore, for example, prior to drilling the subject wellbore. In some embodiments, the anti-collision system performs one or more of the features described herein during an operation of the downhole system, such as during drilling of the subject wellbore. For example, as discussed herein, the trajectory manager (and all the associated functions of the data manager, escape zone manager, etc.) may determine one or more candidate trajectories as a projection below or ahead of the subject wellbore (e.g., ahead of a bit). The projection may be to a threshold distance, such as 200 ft, or may be a projection to a target. In some embodiments, the projection is made at predetermined intervals, such as at every foot. In some embodiments, the projection is made continuously. In this way, the anti-collision workflow described herein may be performed while actively drilling (and intermittently updated) to reduce the risk of collision of the subject wellbore as obstacles are encountered.

In some embodiments, the anti-collision system facilitates implementing a trajectory in connection with the downhole system. For example, the anti-collision system may determine a (e.g., optimal) trajectory and may automatically implement the trajectory. For example, the anti-collision system may communicate the trajectory to a steering system of the downhole system for implementation. In some embodiments, the anti-collision system facilitates implementing the trajectory in combination with user input.

In some embodiments, the anti-collision system implements an example workflow, according to at least one embodiment of the present disclosure. The workflow may be implemented by and/or across one or more of the components of the anti-collision system according to that discussed herein.

In planning for the subject wellbore, a planned trajectory may be determined for the subject wellbore to reach and/or access a target such as an underground reservoir. In drilling the subject wellbore, one or more deviations or changes to the planned trajectory may be implemented, such as in response to determined collision risks as discussed above. The anti-collision system may implement the workflow to account for one or more changes to the trajectory and/or the anti-collision analysis of the subject wellbore.

The anti-collision system may review the trajectory of the subject wellbore, including the anti-collision analysis for the associated trajectory. The trajectory may be a planned trajectory (e.g., planned prior to drilling) or may be a trajectory currently being implemented (e.g., currently being drilled). In reviewing the trajectory, the anti-collision system may check for the offset wellbores. For example, the anti-collision system may access the offset wellbore data and/or the subject wellbore data. The anti-collision system may review the TC plot, no-go zones, current wellbore trajectory, or any other data. As part of this review, the anti-collision system may verify whether the offset wellbores included in the anti-collision analysis (e.g., in the TC plot) of the subject wellbore are still relevant to the current trajectory and/or at the current depth of the subject wellbore. Offset wellbores may be relevant when they are within a threshold proximity to the subject wellbore at one or more (or all) depths, such as at the surface, or at the current MD. If determined that one or more offset wellbores are missing from the current trajectory (e.g., one or more offset wellbores were not accounted for in the associated anti-collision analysis), the anti-collision system may proceed to get additional offset wellbore data. For example, the anti-collision system may access a database of the offset wellbore data to get data pertaining to the (e.g., now) relevant offset wellbores. The anti-collision system may proceed to review the trajectory and/or anti-collision analysis and may loop through this process until it is determined at that all of the relevant wellbores are now included in the offset wellbore data.

When it is determined that no relevant offset wellbores are missing, the anti-collision system may verify whether there have been any changes to the trajectory. Based on changes to the trajectory, the anti-collision system may proceed to get subject wellbore data. For example, the anti-collision system may get the anti-collision analysis for the new trajectory. In some embodiments, the anti-collision system determines the anti-collision analysis for the new trajectory, such as described herein. The anti-collision system may loop through one or more of the acts of the workflow until it is determined that the trajectory and associated anti-collision analysis is current and updated. The anti-collision system may then facilitate proceeding with drilling of the subject wellbore. In this way, the anti-collision system may ensure that the data associated with the subject wellbore is updated and relevant.

In some embodiments, the anti-collision system implements an example workflow, according to at least one embodiment of the present disclosure. The workflow may be implemented by and/or across one or more of the components of the anti-collision system according to that discussed herein. Additionally, the workflow may be implemented in connection with, or independent of, one or more other workflows described herein.

The workflow may be implemented to analyze and/or account for collision risks as a projection ahead of the subject wellbore. The anti-collision system may project ahead of the subject wellbore, or may analyze the subject wellbore data and/or the offset wellbore data for a predetermined distance ahead of the subject wellbore (e.g., ahead of a bit). For example, the anti-collision system may project 50 ft., 100 ft., 150 ft., 200 ft., 250 ft., 300 ft, or any other distance (or distance therebetween) ahead of the subject wellbore. In another example, the anti-collision system may project ahead of the bit to a (e.g., next) target for the subject wellbore. In this way, the anti-collision system may operate during drilling of the subject wellbore to account for collision risks in an immediate proximity ahead of a MD of the subject wellbore.

In projecting ahead, the anti-collision system may generate a TC plot, as well as determine safe points and an escape zone for the projection distance, as described herein. The anti-collision system may determine a collision risk for the current trajectory based on the TC plot (e.g., based on the escape zone). If there is no collision risk, the anti-collision system may facilitate continuing drilling of the subject wellbore according to the current trajectory, such as by implementing the trajectory, or indicating that the trajectory may continue to be followed. A determination of no collision risk may correspond with substantially no collision risk (e.g., 0%), or may correspond with a collision risk below a threshold value. For example, a determination of no collision risk may correspond to a collision risk below 30%, below 20%, below 10%, below 5%, below 1% or any other value (and values therebetween).

If the anti-collision system determines that there is a collision risk, the anti-collision system may proceed to analyze the collision risk. For example, the anti-collision system may classify or categorize the collision risk as minor or major. A minor collision risk may be a collision risk under a threshold value. For example, a minor collision risk may be a collision risk under 50%, 45%, 40%, 35%, 30%, 25%, or any other value (and values therebetween). A major collision risk may be a collision risk over a threshold value. For example, a major collision risk may be a collision risk over 50%, 60%, 70%, 80%, 90%, 95%, 99%, or any other value (and values therebetween). In this way, a minor collision risk may correspond to a collision risk that is greater than the threshold for a determination of no collision risk, but less than that of a major collision risk. The threshold for a determination of no risk, minor risk, and/or major risk may be defined in one or more applicable rulesets associated with the subject wellbore as described herein. The rulesets may user defined, system defined, industry standards, or from any other source. Additionally, the anti-collision system may facilitate one or more changes, updates, or overrides of one or more rules of a ruleset in order to provide flexibility to a user of the anti-collision system for performing downhole operations in connection with the subject wellbore. In some embodiments, the anti-collision system 120 determines the collision risk based on a separation factor. For example, the anti-collision system 120 may implement any of a variety of techniques for determining the separation factor, such determining a perpendicular scan position, a horizontal scan position, a 3D closest approach position. In another example, the anti-collision system 120 may determine the separation factor based on implementing a separation vector method, a pedal curve method, or a scalar/expansion method. The anti-collision system 120 may determine and/or incorporate the separation factor based on any other techniques, such as those known in the industry.

If the collision risk is determined to be minor, the anti-collision system may determine whether there are any candidate or potential trajectories within a lower collision risk. For example, as discussed above, the anti-collision system may determine one or more candidate trajectories within the escape zone of the TC plot for the subject well. The anti-collision system may determine a collision risk for the candidate trajectories. If there are not candidate trajectories with a lower collision risk, the anti-collision system may facilitate continuing to implement the current trajectory and may ultimately loop back to monitoring the projection ahead. If there are one or more candidate trajectories with a lower risk, the anti-collision system may facilitate changing the current trajectory to implement one of the candidate trajectories. For example, a candidate trajectory with a lowest collision risk may be implemented. In another example, a lower-risk candidate trajectory may be implemented in accordance with the cost function as described herein. For example, the anti-collision system may determine a cost associated with one or more (or each) of the lower-risk candidate trajectories and may determine a trajectory to implement based on the cost function, such as a candidate trajectory with a lowest overall cost. The anti-collision system may accordingly facilitate implementing the selected trajectory and may proceed back to monitoring the projection ahead. In this way, the drilling of the subject well may proceed in the presence of a minor risk while the current trajectory is being analyzed (and potentially while a new trajectory is being determined). Additionally, the anti-collision system may facilitate implementing a trajectory with the lowest collision risk and/or lowest cost during drilling of the subject well.

If the collision risk is determined to be major, the anti-collision system may determine if there is an applicable exemption to the major risk. For example, the anti-collision system may access an applicable or current ruleset (e.g., in the drilling plan) for the subject wellbore and may determine whether the ruleset defines an exemption that applies to the associated major collision risk. If no applicable exemption is identified, the anti-collision system may facilitate stopping drilling. Similarly, the anti-collision system may identify an applicable exemption in the ruleset, but may determine that the exemption is not satisfied and may accordingly facilitate stopping drilling. In some embodiments, the anti-collision system automatically stops drilling of the subject wellbore such as through an automated failsafe. In some embodiments, the anti-collision system indicates one or more warnings or alerts to a user to stop drilling operations due to the major collision risk. In this way, drilling of the subject wellbore may be stopped, for example, until measures may be taken to mitigate the major risk. For example, drilling may be stopped in order to determine a new trajectory that avoids the associated risks. In another example, drilling may be stopped in order to validate, overcome, or exempt the associated risk with the current trajectory. Stopping drilling in this way in light of a major risk may be in contrast to, for example, a minor risk, in which collision analysis and trajectory selection may take place while continuing drilling.

An exemption defined by a ruleset may take any of a number of forms. For example, an exemption may exist for a specific offset wellbore and/or no-go zone known or predicted to be inaccurate. In another example, an exemption may exist for proceeding with a collision risk that surpasses the major risk threshold by only a small amount, such as 1%-5%. In another example, an exemption may exist for proceeding with a trajectory if the associated major risk is the least risky of one or more possible alternative trajectories, or if the trajectory is selected by the cost function despite the major risk. In another example, an exemption may take the form of a user overriding a given major risk. An exemption may take the form of any other scenario or rule in accordance with that discussed herein.

For example, exemptions may be generated, documented and or planned for as part of a planning phase of the wellbore. Based on a planning-phase risk analysis, a non-compliance may be identified for the wellbore and/or trajectory design with respect to the no-go zones, lease lines, etc. Documented evidence may be gathered and prepared in order to determine and support a mitigation plan for overcoming the noncompliance. Based on the approval of the mitigation plan, an exemption may be documented and incorporated for overcoming the associated non-compliance if and/or when it is encountered. During operation of the downhole system, the anti-collision system may identify an applicable (e.g., planned) exemption and may apply the exemption and/or proceed drilling despite the risk, or despite the noncompliance of the trajectory. If the trajectory is determined to violate the exemption, for example, by further exceeding the bounds set by even the exemption, the anti-collision system may facilitate reporting the violation, and stopping the drilling operation if necessary. In this way, exemptions may be implemented into the workflow of the anti-collision system described herein.

If the anti-collision system identifies an applicable exemption, and determines that the exemption is satisfied, the anti-collision system may proceed back to assess possible candidate trajectories to implement as discussed herein (and continue drilling). In this way, the workflow may utilize the features of the anti-collision system discussed herein (e.g., generating TC plots, determining escape zones, determining trajectories, determining collision risks) during drilling of the subject wellbore to incorporate the anti-collision analysis into the steering of the downhole system.

In some embodiments, a method or a series of acts is implemented for preventing a collision of a subject wellbore in a downhole environment as described herein, according to at least one embodiment of the present disclosure. Alternatively, a non-transitory computer-readable storage medium may include instructions that, when executed by one or more processors, cause a computing device to perform the acts of the method. In still further implementations, a system may perform the acts of the method.

In some embodiments, the method includes an act of receiving offset wellbore data corresponding with one or more offset wellbores. In some embodiments, an anti-collision system updates the offset wellbore data for at least one of the offset wellbores based on a validation of the offset wellbore data during drilling of the subject wellbore. For example, the anti-collision system may adjust (or facilitate adjusting) the no-go zone for at least one of the offset wellbores.

In some embodiments, the method includes an act of identifying, based on the offset wellbore data, a no-go zone for each of the one or more offset wellbores. The no-go zones may correspond to an uncertainty associated with a location of the offset wellbores.

In some embodiments, the method includes an act of determining a plurality of safe points corresponding with a potential intersection of the subject wellbore with the one or more no-go zones. In some embodiments, the anti-collision system selects each safe point from a plurality of candidate safe points based on a proximity to the subject wellbore. For example, the offset wellbore data, including the no-go zones, may be represented in a 2-dimensional coordinate system, such as a traveling cylinder plot, that represents a proximity of the one or more offset wellbores to the subject wellbore at a plurality of depths. The anti-collision system may segment the 2-dimensional coordinate system into a plurality of segments. For each segment, the anti-collision system may determine one or more candidate safe points associated with an intersection of the segment with one or more no-go zones. The anti-collision system may further select a safe point for the segment based on the safe point being a most restrictive of the one or more candidate safe points.

In some embodiments, the method includes an act of defining an escape zone within the plurality of safe points. For example, the anti-collision system may determine the plurality of safe points and may define the escape zone automatically and without user input. In some embodiments, the anti-collision system receives lease line data corresponding to a geographical boundary for the subject wellbore to be drilled, and the anti-collision system further defines the escape zone based on the lease line data.

In some embodiments, the method includes an act of determining a trajectory for the subject wellbore within the escape zone. In some embodiments, the anti-collision system determines a collision risk associated with the trajectory. For example, the collision risk may be determined based on a proximity of the trajectory with the boundary of the escape zone. In some embodiments, the anti-collision system determines a plurality of candidate trajectories within the escape zone and a collision risk for each of the candidate trajectories. The anti-collision system may further select the trajectory from the plurality of candidate trajectories based on the determined collision risks. For example, the anti-collision system may select a trajectory having a lower collision risk than one or more of the candidate trajectories. In another example, the anti-collision system may select a trajectory having a collision risk within a collision risk threshold. In another example, the anti-collision system may select the trajectory based on a cost function incorporating a plurality of factors in addition to the collision risk. In some embodiments, the method 600 is performed while drilling the subject wellbore. In some embodiments, the method 600 includes implementing the trajectory in associated with the subject wellbore.

In some embodiments, certain components may be included within a computer system. One or more computer systems may be used to implement the various devices, components, and systems described herein.

The computer system includes a processor. The processor may be a general-purpose single- or multi-chip microprocessor (e.g., an Advanced RISC (Reduced Instruction Set Computer) Machine (ARM)), a special purpose microprocessor (e.g., a digital signal processor (DSP)), a microcontroller, a programmable gate array, etc. The processor may be referred to as a central processing unit (CPU). Although just a single processor is described, in an alternative configuration, a combination of processors (e.g., an ARM and DSP) could be used.

The computer system also includes memory in electronic communication with the processor. The memory may include computer-readable storage media and may be any available media that may be accessed by a general purpose or special purpose computer system. Computer-readable media that store computer-executable instructions are non-transitory computer-readable media (device). Computer-readable media that carry computer-executable instructions are transmission media. Thus, by way of example and not limitations, embodiment of the present disclosure may comprise at least two distinctly different kinds of computer-readable media: non-transitory computer-readable media (devices) and transmission media.

Both non-transitory computer-readable media (devices) and transmission media may be used temporarily to store or carry software instructions in the form of computer readable program code that allows performance of embodiments of the present disclosure. Non-transitory computer-readable media may further be used to persistently or permanently store such software instructions. Examples of non-transitory computer-readable storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which may be used to store program code in the form of computer-executable instructions or data structures and which may be accessed by a general purpose or special purpose computer, whether such program code is stored or in software, hardware, firmware, or combinations thereof.

Instructions and data may be stored in the memory. The instructions may be executable by the processor to implement some or all of the functionality disclosed herein. Executing the instructions may involve the use of the data that is stored in the memory. Any of the various examples of modules and components described herein may be implemented, partially or wholly, as instructions stored in memory and executed by the processor. Any of the various examples of data described herein may be among the data that is stored in memory and used during execution of the instructions by the processor.

A computer system may also include one or more communication interfaces for communicating with other electronic devices. The communication interface(s) may be based on wired communication technology, wireless communication technology, or both. Some examples of communication interfaces include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

The communication interfaces may connect the computer system to a network. A "network" or "communications network" may generally be defined as one or more data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media may include a communication network and/or data links, carrier waves, wireless signals, and the like, which may be used to carry desired program or template code means or instructions in the form of computer-executable instruction or data structures and which may be accessed by a general purpose or special purpose computer.

A computer system may also include one or more input devices and one or more output devices. Some examples of input devices include a keyboard, mouse, microphone, remote control device, button, joystick, trackball, touchpad, and lightpen. Some examples of output devices include a speaker and a printer. One specific type of output device that is typically included in a computer system is a display device. Display devices used with embodiments disclosed herein may utilize any suitable image projection technology, such as liquid crystal display (LCD), light-emitting diode (LED), gas plasma, electroluminescence, or the like. A display controller may also be provided, for converting data stored in the memory into text, graphics, and/or moving images (as appropriate) shown on the display device.

The various components of the computer system may be coupled together by one or more buses, which may include a power bus, a control signal bus, a status signal bus, a data bus, etc.

The techniques described herein may be implemented in hardware, software, firmware, or any combination thereof, unless specifically described as being implemented in a specific manner. Any features described as modules, components, or the like may also be implemented together in an integrated logic device or separately as discrete but interoperable logic devices. If implemented in software, the techniques may be realized at least in part by a non-transitory processor-readable storage medium comprising instructions that, when executed by at least one processor, perform one or more of the methods described herein. The instructions may be organized into routines, programs, objects, components, data structures, etc., which may perform particular tasks and/or implement particular data types, and which may be combined or distributed as desired in various embodiments.

Further, upon reaching various computer system components, program code in the form of computer-executable instructions or data structures may be transferred automatically or manually from transmission media to non-transitory computer-readable storage media (or vice versa). For example, computer executable instructions or data structures received over a network or data link may be buffered in memory (e.g., RAM) within a network interface module (NIC), and then eventually transferred to computer system RAM and/or to less volatile non-transitory computer-readable storage media at a computer system. Thus, it should be understood that non-transitory computer-readable storage media may be included in computer system components that also (or even primarily) utilize transmission media.

The following are non-limiting examples of various embodiment of the present disclosure.

A1. A method of preventing a collision of a subject wellbore in a downhole environment, comprising:
- receiving offset wellbore data corresponding with one or more offset wellbores;
- identifying, based on the offset wellbore data, one or more no-go zones for each of the one or more offset wellbores;
- determining a plurality of safe points corresponding with a potential intersection of the subject wellbore with the one or more no-go zones;
- defining an escape zone within the plurality of safe points; and
- determining a trajectory for the subject wellbore within the escape zone.

A2. The method of A1, further comprising receiving lease line data corresponding with a geographical boundary for the subject wellbore to be drilled, wherein the escape zone is further defined based on the lease line data.

A3. The method of A1 or A2, wherein determining the plurality of safe points and defining the escape zone are each performed automatically and without user input.

A4. The method of any of A1-A3, wherein the method is performed while drilling the subject wellbore.

A5. The method of any of A1-A4, wherein the no-go zone for each of the one or more offset wellbores corresponds to an uncertainty associated with a location of the offset wellbore.

A6. The method of any of A1-A5, wherein determining the plurality of safe points includes, selecting each of the safe points from a plurality of candidate safe points based on a proximity to the subject wellbore.

A7. The method of any of A1-A6, further comprising updating the offset wellbore data for at least one of the offset wellbores based on a validation of the offset wellbore data during drilling of the subject wellbore.

A8. The method of A7, wherein updating the offset wellbore data includes adjusting the no-go zone for at least one of the offset wellbores.

A9. The method of any of A1-A8, wherein the offset wellbore data, including the no-go zones, are represented in a 2-dimensional coordinate system that represents a proximity of the one or more offset wellbores to the subject wellbore at a plurality of depths.

A10. The method of A9, wherein the 2-dimensional coordinate system is a traveling cylinder plot.

A11. The method of A9 or A10, wherein determining the plurality of safe points includes segmenting the 2-dimensional coordinate system into a plurality of segments, and for each segment:
- determining one or more candidate safe points associated with an intersection of the segment with one or more no-go zones; and
- selecting a safe point for the segment based on the safe point being a most restrictive of the one or more candidate safe points.

A12. The method of any of A1-A11. Further comprising determining a collision risk associated with the trajectory.

A13. The method of A12, wherein the collision risk is associated with a proximity of the trajectory with a boundary of the escape zone.

A14. The method of any of A1-A13, wherein determining the trajectory includes:
- determining a plurality of candidate trajectories within the escape zone;
- for each of the plurality of candidate trajectories, determining a collision risk based on a proximity of the candidate trajectory with a boundary of the escape zone; and
- selecting the trajectory from the plurality of candidate trajectories based on the determined collision risks.

A15. The method of A14, wherein selecting the trajectory based on the determined collision risks includes selecting the trajectory based on the collision risk of the selected trajectory being lower than one or more of the candidate trajectories.

A16. The method of A14 or A15, wherein selecting the trajectory based on the determined collision risks includes selecting the trajectory based on the collision risk of the selected trajectory being within a collision risk threshold.

A17. The method of any of A14-A16, wherein selecting the trajectory is based on a cost function incorporating a plurality of factors in addition to the collision risk.

A18. The method of any of A1-A17, further comprising causing the trajectory to be implemented in association with the subject wellbore.

A19. The method of any of A1-A17, wherein determining the trajectory includes determining the trajectory based on an observed user preference from past trajectory determinations.

B1. A system, comprising:

one or more processors;

a memory in electronic communication with the one or more processors; and instructions stored in the memory, the instructions being executable by the one or more processors to:

receive offset wellbore data corresponding with one or more offset wellbores;

identify, based on the offset wellbore data, a no-go zone for each of the one or more offset wellbores;

determine a plurality of safe points corresponding with a potential intersection of a subject wellbore with the one or more no-go zones;

based on the plurality of safe points, define an escape zone within the plurality of safe points; and determine a trajectory for the subject wellbore within the escape zone.

C1. A computer-readable storage medium including instruction that, when executed by at least one processor, cause the processor to:

receive offset wellbore data corresponding with one or more offset wellbores;

identify, based on the offset wellbore data, a no-go zone for each of the one or more offset wellbores;

determine a plurality of safe points corresponding with a potential intersection of a subject wellbore with the one or more no-go zones;

based on the plurality of safe points, define an escape zone within the plurality of safe points; and determine a trajectory for the subject wellbore within the escape zone.

The embodiments of the anti-collision system have been primarily described with reference to wellbore drilling operations; the anti-collision system described herein may be used in applications other than the drilling of a wellbore. In other embodiments, the anti-collision system according to the present disclosure may be used outside a wellbore or other downhole environment used for the exploration or production of natural resources. For instance, the anti-collision system of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of preventing a collision of a subject wellbore in a downhole environment, comprising:

receiving offset wellbore data corresponding with one or more offset wellbores, the offset wellbore data indicating, for each of the one or more offset wellbores, an offset trajectory for the one or more offset wellbores;

identifying, based on the offset wellbore data, a plurality of no-go zones including at least one no-go zone for each of the one or more offset wellbores, wherein, for each offset wellbore of the one or more offset wellbores, the at least one no-go zone indicates a threshold uncertainty of an expected location of the offset trajectory for the one or more offset wellbores at one or more measurement depths;

generating a traveling cylinder plot for the subject wellbore that projects ahead of the subject wellbore a projection distance, the traveling cylinder plot having a coordinate system with an origin and indicating, across the projection distance, the at least one no-go zone for each of the one or more offset wellbores in the coordinate system;

determining, based on the traveling cylinder plot, a plurality of safe points, each safe point of the plurality of safe points associated with a segment of a plurality of segments of the traveling cylinder plot, wherein each segment of the plurality of segments comprises a line from the origin to a perimeter of the traveling cylinder plot, and wherein determining the plurality of safe points comprises, for each segment:

determining a plurality of candidate safe points based on intersections of the segment with a boundary of the plurality of no-go zones; and selecting a segment safe point for the plurality of safe points, the segment safe point including a closest candidate safe point from the plurality of candidate safe points, wherein the closest candidate safe point is closest to the origin;

generating an escape zone by defining a plurality of tolerance lines between adjacent safe points of the plurality of safe points, the adjacent safe points associated with adjacent segments of the plurality of segments;

determining a trajectory for the subject wellbore that does not intersect the one or more offset wellbores, wherein the trajectory is generated within the escape zone; and steering a downhole tool to implement the trajectory and to form the subject wellbore to avoid collisions with the one or more offset wellbores.

2. The method of claim 1, further comprising receiving lease line data corresponding with a geographical boundary for the subject wellbore to be drilled, wherein the escape zone is further defined based on the lease line data.

3. The method of claim 1, wherein determining the trajectory includes determining the trajectory based on an observed user preference from past trajectory determinations.

4. The method of claim 1, wherein the method is performed while drilling the subject wellbore.

5. The method of claim 1, further comprising updating the offset wellbore data for at least one wellbore of the one or more offset wellbores based on a validation of the offset wellbore data during drilling of the subject wellbore.

6. The method of claim 5, wherein updating the offset wellbore data includes adjusting the at least one no-go zone for the at least one wellbore of the one or more offset wellbores.

7. The method of claim 1, wherein the coordinate system of the traveling cylinder plot is a 2-dimensional coordinate system that represents a proximity of the one or more offset wellbores to the subject wellbore at a plurality of depths.

8. The method of claim 1, further comprising determining a collision risk associated with the trajectory.

9. The method of claim 8, wherein the collision risk is associated with a proximity of the trajectory with a boundary of the escape zone.

10. The method of claim 1, wherein determining the trajectory includes:

determining a plurality of candidate trajectories within the escape zone;

determining a plurality of collision risks, each collision risk associated with an associated candidate trajectory of the plurality of candidate trajectories, wherein the plurality of collision risks are based on a proximity of the associated candidate trajectory of the plurality of candidate trajectories with an escape zone boundary of the escape zone; and selecting the trajectory from the plurality of candidate trajectories based on the plurality of collision risks associated with the plurality of candidate trajectories.

11. The method of claim 10, wherein selecting the trajectory includes selecting the trajectory based on a lowest collision risk of the plurality of collision risks.

12. The method of claim 10, wherein selecting the trajectory includes selecting the trajectory based on the trajectory being associated with a selected collision risk of the plurality of collision risks that is within a collision risk threshold.

13. The method of claim 10, wherein selecting the trajectory is based on a cost function incorporating a plurality of factors, the plurality of factors including the plurality of collision risks.

14. A system, comprising:

one or more processors;

a memory in electronic communication with the one or more processors; and instructions stored in the memory, the instructions being executable by the one or more processors to:

receive offset wellbore data corresponding with one or more offset wellbores, the offset wellbore data indicating, for each of the one or more offset wellbores, an offset trajectory for the one or more offset wellbores;

identify, based on the offset wellbore data, a plurality of no-go zones including at least one no-go zone for each of the one or more offset wellbores, wherein, for each offset wellbore of the one or more offset wellbores, the at least one no-go zone indicates a threshold uncertainty of an expected location of the offset trajectory for the one or more offset wellbores at one or more measurement depths;

generate a traveling cylinder plot for a subject wellbore that projects ahead of the subject wellbore a projection distance, the traveling cylinder plot having a coordinate system with an origin and indicating, across the projection distance, the at least one no-go zone for each of the one or more offset wellbores in the coordinate system;

determine, based on the traveling cylinder plot, a plurality of safe points, each safe point of the plurality of safe points associated with a segment of a plurality of segments of the traveling cylinder plot, wherein each segment of the plurality of segments comprises a line from the origin to a perimeter of the traveling cylinder plot, and wherein determining the plurality of safe points comprises, for each segment:

determining a plurality of candidate safe points based on intersections of the segment with a boundary of the plurality of no-go zones; and selecting a segment safe point for the plurality of safe points, the segment safe point including a closest candidate safe point from the plurality of candidate safe points, wherein the closest candidate safe point is closest to the origin;

generate an escape zone by defining a plurality of tolerance lines between adjacent safe points of the plurality of safe points, the adjacent safe points associated with adjacent segments of the plurality of segments;

determine a trajectory for the subject wellbore that does not intersect the one or more offset wellbores, wherein the trajectory is generated within the escape zone; and steer a downhole tool to implement the trajectory and to form the subject wellbore to avoid collisions with the one or more offset wellbores.

15. A computer-readable storage medium including instruction that, when executed by at least one processor, cause the processor to:

receive offset wellbore data corresponding with one or more offset wellbores, the offset wellbore data indicating, for each of the one or more offset wellbores, an offset trajectory for the one or more offset wellbores;

identify, based on the offset wellbore data, a plurality of no-go zones including at least one no-go zone for each of the one or more offset wellbores, wherein, for each offset wellbore of the one or more offset wellbores, the at least one no-go zone indicates a threshold uncertainty of an expected location of the offset trajectory for the one or more offset wellbores at one or more measurement depths;

generate a traveling cylinder plot for a subject wellbore that projects ahead of the subject wellbore a projection distance, the traveling cylinder plot having a coordinate system with an origin and indicating, across the projection distance, the at least one no-go zone for each of the one or more offset wellbores in the coordinate system;

determine, based on the traveling cylinder plot, a plurality of safe points, each safe point of the plurality of safe points associated with a segment of a plurality of segments of the traveling cylinder plot, wherein each segment of the plurality of segments comprises a line from the origin to a perimeter of the traveling cylinder plot, and wherein determining the plurality of safe points comprises, for each segment:

determining a plurality of candidate safe points based on intersections of the segment with a boundary of the plurality of no-go zones; and selecting a segment safe point for the plurality of safe points, the segment safe point including a closest candidate safe point from the plurality of candidate safe points, wherein the closest candidate safe point is closest to the origin;

generate an escape zone by defining a plurality of tolerance lines between adjacent safe points of the plurality of safe points, the adjacent safe points associated with adjacent segments of the plurality of segments;

determine a trajectory for the subject wellbore that does not intersect the one or more offset wellbores, wherein the trajectory is generated within the escape zone; and steer a downhole tool to implement the trajectory and to form the subject wellbore to avoid collisions with the one or more offset wellbores.

16. The method of claim 1, further comprising:

while performing drilling activities, iteratively receiving additional offset wellbore data;

while performing the drilling activities, iteratively updating the traveling cylinder plot with the additional offset wellbore data;

while performing the drilling activities, iteratively generating an updated escape zone using the updated traveling cylinder plot;

while performing the drilling activities, iteratively generating an updated trajectory by comparing the trajectory to the updated escape zone; and steering the downhole tool to implement the updated trajectory.

* * * * *